US010551756B1

(12) United States Patent
Murakami et al.

(10) Patent No.: US 10,551,756 B1
(45) Date of Patent: Feb. 4, 2020

(54) IMAGE FORMING APPARATUS AND METHOD FOR FORMING IMAGE

(71) Applicant: FUJI XEROX CO., LTD., Tokyo (JP)

(72) Inventors: Tsuyoshi Murakami, Kanagawa (JP); Kana Yoshida, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/262,959

(22) Filed: Jan. 31, 2019

(30) Foreign Application Priority Data

Sep. 26, 2018 (JP) ..... 2018-180854

(51) Int. Cl.
*G03G 9/087* (2006.01)
*G03G 15/20* (2006.01)

(52) U.S. Cl.
CPC ..... *G03G 9/08797* (2013.01); *G03G 9/08755* (2013.01); *G03G 15/2053* (2013.01)

(58) Field of Classification Search
CPC .... G03G 9/08797; G03G 15/06; G03G 15/08; G03G 2215/0602; G03G 2215/0604; G03G 2215/0607
See application file for complete search history.

(56) References Cited

U.S. PATENT DOCUMENTS 8,761,650 B2 6/2014 Takagi et al.
2011/0222881 A1* 9/2011 Yamada ..... G03G 15/2032 399/45

(Continued)

FOREIGN PATENT DOCUMENTS

JP 2012118488 6/2012

*Primary Examiner* — Thomas S Giampaolo, II
(74) *Attorney, Agent, or Firm* — JCIPRNET

(57) ABSTRACT

An image forming apparatus includes an image holding member; a charging unit that charges the surface of the image holding member; an electrostatic charge image forming unit that forms an electrostatic charge image on the charged surface of the image holding member; a developing unit that has an electrostatic charge image developer and that develops the electrostatic charge image on the surface of the image holding member with the electrostatic charge image developer to form a toner image; a transfer unit that transfers the toner image formed on the surface of the image holding member to a recording medium; and a fixing unit that includes a fixing belt that comes into contact with the toner image transferred to the recording medium, a rotational member that is disposed in contact with the outer surface of the fixing belt and that forms a contact area between the fixing belt and the rotational member, and a heat source that is disposed so as to face the inner surface of the fixing belt to directly heat the fixing belt, wherein the electrostatic charge image developer contains a toner that has a temperature $T_1$ at a storage modulus of $G'=1\times10^8$ Pa and a temperature $T_2$ at a storage modulus of $G'=1\times10^6$ Pa and that satisfies a condition 1 and a condition 2, and the recording medium having the transferred toner image passes through the contact area to fix the toner image to the recording medium Condition 1: $1.215 \leq T_2/T_1 \leq 1.365$ Condition 2: $50° C. \leq T_1 \leq 68° C.$

7 Claims, 4 Drawing Sheets

(56) References Cited

U.S. PATENT DOCUMENTS

| | | | | |
|---|---|---|---|---|
| 2012/0121303 | A1* | 5/2012 | Takagi | G03G 15/2053<br>399/329 |
| 2013/0309603 | A1* | 11/2013 | Takahashi | G03G 9/0821<br>430/109.1 |
| 2014/0255840 | A1* | 9/2014 | Sekiguchi | G03G 9/08755<br>430/105 |

* cited by examiner

IMAGE FORMING APPARATUS AND METHOD FOR FORMING IMAGE

CROSS-REFERENCE TO RELATED APPLICATIONS

This application is based on and claims priority under 35 USC 119 from Japanese Patent Application No. 2018-180854 filed Sep. 26, 2018.

BACKGROUND

(i) Technical Field

The present disclosure relates to an image forming apparatus and a method for forming an image.

(ii) Related Art

An electrophotographic process for forming an image, for example, includes charging the surface of an image holding member, forming an electrostatic charge image on this surface of the image holding member on the basis of image information, developing the electrostatic charge image with a developer containing toner to form a toner image, and transferring and fixing the toner image to the surface of a recording medium.

Japanese Laid Open Patent Application Publication No. 2012-118488 discloses a fixing device that includes a fixing member which is in the form of a rotatable endless belt having a flexibility, a pressing member which is disposed so as to be able to press the fixing member from the outside of the fixing member, an abutting member which is disposed so as to face the inner surface of the fixing member and abuts on the pressing member with the fixing member pressed by the pressing member being interposed therebetween, a support member which is disposed so as to face the inner surface of the fixing belt and supports the abutting member against the direction in which the pressing member presses the fixing member, a heater which heats the fixing member, and a shape maintaining unit which is disposed at each of the two ends of the fixing member and directly or indirectly in sliding contact with the inner surface of the fixing member to maintain the shape of the fixing member, wherein the pressing member has a first central axis that is vertical to a transport direction in the cross-sectional direction, the shape maintaining unit has a second central axis that is vertical to the transport direction in the cross-sectional direction, the heater is provided upstream of the first central axis in the transport direction, and the support member is provided downstream of the second central axis in the transport direction.

In some electrophotographic image forming apparatuses, a fixing device includes a rotational member, such as a pressing roller, and a fixing belt having a smaller heat capacity than a fixing roller; and the fixing belt is directly heated from the inside.

Such a fixing device is good in reductions in its size, energy consumption, and production costs. The structure in which the fixing belt having a small heat capacity is directly heated from the inside, however, causes the temperature of the fixing belt to decrease when recording media continuously pass between the fixing belt and the rotational member; in addition, once a heat source starts heating in response to such a decrease in the temperature, the surface temperature of the fixing belt may exceed the intended fixing temperature in some cases (this phenomenon is also referred to as "overshoot"). In the case where the overshoot occurs in, for example, double-sided printing (particularly in double-sided printing of a solid image on the entire surface), the heat of the fixing belt is transferred to a fixed image on the back side (namely, a fixed image that is to contact the pressing roller), and part of the fixed image on the back side is re-melted. This melted image may adhere to the pressure roller, which results in the occurrence of image defects, such as a blank image and uneven image density, in some cases.

The occurrence of such image defects brought about by the overshoot may be reduced by, for example, enhancement in the re-melting temperature of the fixed image or an increase in the amount of a release agent that comes out of the fixed image; however, such techniques impair fixability at low temperature, or the release agent that has come out of the fixed image contaminates the fixing belt. Hence, a technique different from those techniques needs to be studied.

SUMMARY

Aspects of non-limiting embodiments of the present disclosure relate to an image forming apparatus that includes a fixing unit having the above-mentioned structure and that enables a reduction in the occurrence of image defects brought about by re-melting of a fixed image in double-sided printing as compared with using a developing unit that has an electrostatic charge image developer containing a toner which has a temperature $T_1$ at a storage modulus of $G'=1\times10^8$ Pa and a temperature $T_2$ at a storage modulus of $G'=1\times10^6$ Pa and which satisfies any of the following conditions: $T_2/T_1$ is less than 1.215, and $T_1$ is less than 50° C.; and $T_2/T_1$ is larger than 1.365, and $T_1$ larger than 68° C.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image holding member; a charging unit that charges the surface of the image holding member; an electrostatic charge image forming unit that forms an electrostatic charge image on the charged surface of the image holding member; a developing unit that has an electrostatic charge image developer and that develops the electrostatic charge image on the surface of the image holding member with the electrostatic charge image developer to form a toner image; a transfer unit that transfers the toner image formed on the surface of the image holding member to a recording medium; and a fixing unit that includes a fixing belt that comes into contact with the toner image transferred to the recording medium, a rotational member that is disposed in contact with the outer surface of the fixing belt and that forms a contact area between the fixing belt and the rotational member, and a heat source that is disposed so as to face the inner surface of the fixing belt to directly heat the fixing belt, wherein the electrostatic charge image developer contains a toner that has a temperature $T_1$ at a storage modulus of $G'=1\times10^8$ Pa and a temperature $T_2$ at a storage modulus of $G'=1\times10^6$ Pa and that satisfies a condition 1 and a condition 2, and the recording medium having the transferred toner image passes through the contact area to fix the toner image to the recording medium Condition 1: $1.215 \leq T_2/T_1 \leq 1.365$ Condition 2: $50° \text{ C.} \leq T_1 \leq 68° \text{ C.}$

BRIEF DESCRIPTION OF THE DRAWINGS

An exemplary embodiment of the present disclosure will be described in detail based on the following figures, wherein.

DETAILED DESCRIPTION

Figure 1:
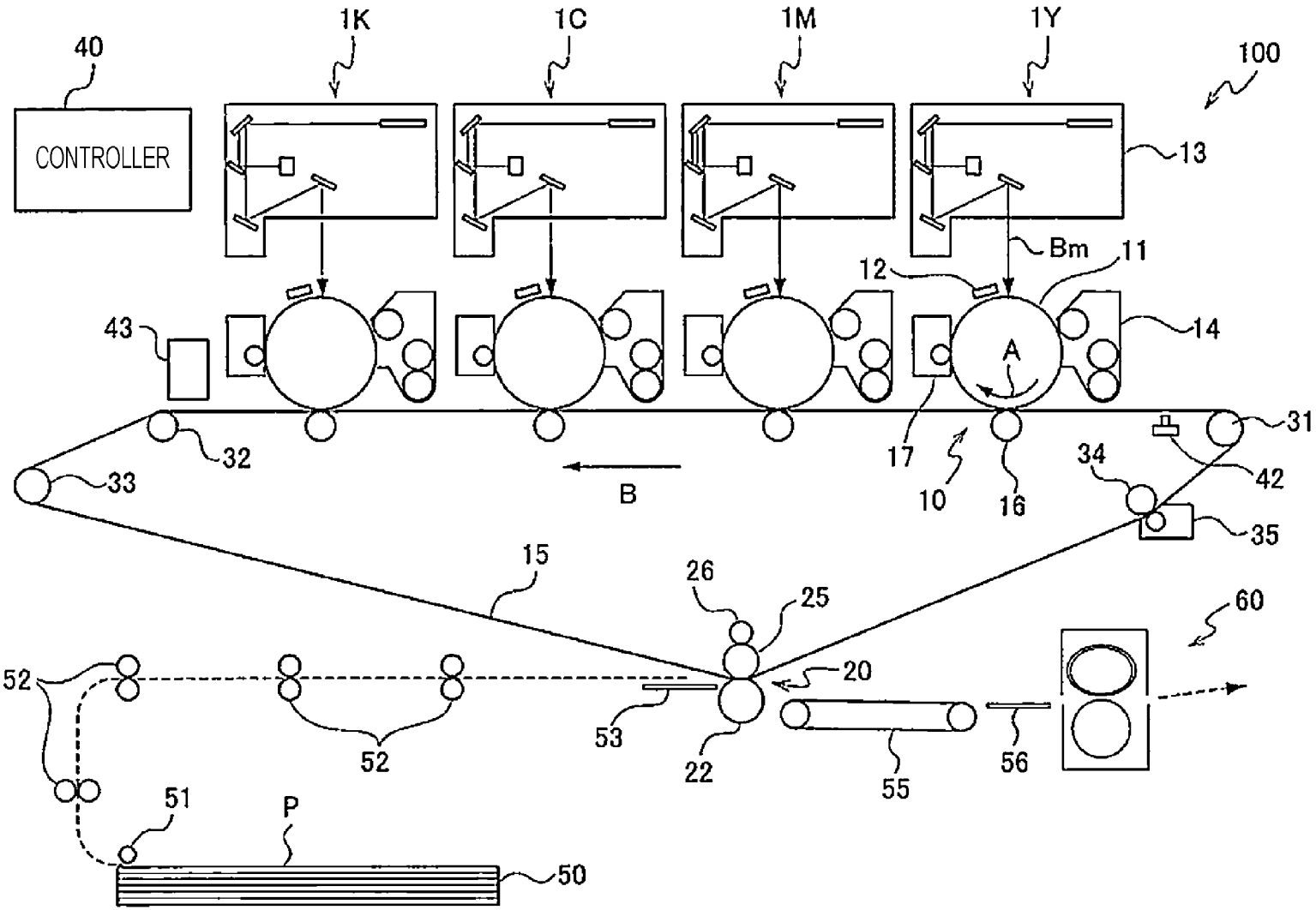
FIG. 1 schematically illustrates an example of the structure of an image forming apparatus according to an exemplary embodiment.

An exemplary embodiment that is an example of the present disclosure will now be described in detail.

Image Forming Apparatus and Method for Forming Image

An image forming apparatus according to an exemplary embodiment includes an image holding member, a charging unit that charges the surface of the image holding member, an electrostatic charge image forming unit that forms an electrostatic charge image on the charged surface of the image holding member, a developing unit that has an electrostatic charge image developer containing toner and that develops the electrostatic charge image on the surface of the image holding member with the electrostatic charge image developer to form a toner image, a transfer unit that transfers the toner image formed on the surface of the image holding member to a recording medium, and a fixing unit that fixes the toner image to the recording medium.

In the image forming apparatus according to the exemplary embodiment, the electrostatic charge image developer accommodated in the developing unit contains a toner (also referred to as "specific toner") that has the temperature $T_1$ at the storage modulus $G'=1\times10^8$ Pa and the temperature $T_2$ at the storage modulus $G'=1\times10^6$ Pa and that satisfies the following conditions 1 and 2.

$$1.215 \leq T_2/T_1 \leq 1.365 \quad \text{Condition 1:}$$

$$50^\circ\ \text{C.} \leq T_1 \leq 68^\circ\ \text{C.} \quad \text{Condition 2:}$$

The fixing unit used in the image forming apparatus according to the exemplary embodiment includes a fixing belt that comes into contact with the toner image transferred to the recording medium, a rotational member disposed in contact with the outer surface of the fixing belt such that a contact area is formed between the rotational member and the fixing belt, and a heat source disposed so as to face the inner surface of the fixing belt to directly heat the fixing belt; and a recording medium having a transferred toner image passes through the contact area to fix the toner image to the recording medium.

The fixing unit having the above-mentioned structure (in particular, as described above, a fixing belt having a small heat capacity and a pressing roller are used, and the fixing belt is directly heated from inside) as in the image forming apparatus according to the exemplary embodiment is good in terms of reductions in its size, energy consumption, and production costs.

Image forming apparatuses including such a fixing unit, however, is likely to suffer the occurrence of overshoot because of the direct heating of the fixing belt with small heat capacity from inside, and this overshoot causes re-melting of a fixed image in double-sided printing and results in the occurrence of image defects in some cases.

Combined use of such a fixing unit and the toner having a specific viscoelasticity (namely, specific toner), however, enables a reduction in the occurrence of image defects due to the re-melting of a fixed image in double-sided printing even when the overshoot is caused.

The specific toner used in combination with the fixing unit satisfies the above-mentioned conditions 1 and 2 and is therefore sufficiently melted in a first fixing process in double-sided printing (fixing of an image to the first side of a recording medium, the same holds true for the below description), and thus the fixed image has a good strength; in addition, the re-melting of a fixed image is likely to be reduced in a second fixing process in the double-sided printing (fixing of an image to the second side of the recording medium that is opposite to the first side, the same holds true for the below description) even when the overshoot occurs. As a result, image defects attributed to the re-melting of the fixed images in double-sided printing is less likely to occur.

The image forming apparatus of the exemplary embodiment may be any of the following known image forming apparatuses: a direct transfer type apparatus in which the toner image formed on the surface of the image holding member is directly transferred to a recording medium, an intermediate transfer type apparatus in which the toner image formed on the surface of the image holding member is transferred to the surface of an intermediate transfer body and in which the toner image transferred to the surface of the intermediate transfer body is then transferred to the surface of a recording medium, and an apparatus which has an erasing unit that radiates light to the surface of the image holding member for removal of charges after the transfer of the toner image and before charging.

In the intermediate transfer type apparatus, the transfer unit, for example, includes an intermediate transfer body of which a toner image is to be transferred to the surface, a first transfer member which transfers the toner image formed on the surface of the image holding member to the surface of the intermediate transfer body, and a second transfer member which transfers the toner image transferred to the surface of the intermediate transfer body to the surface of a recording medium.

In the structure of the image forming apparatus of the exemplary embodiment, for instance, the part that at least includes the image holding member may be in the form of a cartridge that is removably attached to the image forming apparatus (process cartridge).

In the image forming apparatus according to the exemplary embodiment, a method for forming an image is carried out; and the method includes charging the surface of the image holding member, forming an electrostatic charge image on the charged surface of the image holding member, developing the electrostatic charge image on the surface of the image holding member with an electrostatic charge image developer containing the specific toner to form a toner image, transferring the toner image formed on the surface of the image holding member to a recording medium, fixing the toner image transferred to the recording medium, fixing the toner image to the recording medium with the fixing unit which includes a fixing belt that comes into contact with the toner image transferred to the recording medium, a rotational member disposed in contact with the outer surface of the fixing belt such that a contact area is formed between the rotational member and the fixing belt, and a heat source disposed so as to face the inner surface of the fixing belt to directly heat the fixing belt and in which the recording medium having the transferred toner image passes through the contact area to fix the toner image to the recording medium.

The image forming apparatus according to the exemplary embodiment will now be described with reference to the drawings, and a method for forming an image with the image forming apparatus will be also explained.

FIG. 1 schematically illustrates an example of the structure of the image forming apparatus according to the exemplary embodiment.

As illustrated in FIG. 1, an image forming apparatus 100 of the exemplary embodiment is, for example, an intermediate transfer type image forming apparatus that is a so-called tandem type. The image forming apparatus 100 includes image forming units 1Y, 1M, 1C, and 1K that individually form toner images of different color components by an electrophotographic technique; first transfer parts 10 that transfers the toner images of different color components formed by the image forming units 1Y, 1M, 1C, and 1K to an intermediate transfer belt 15 in sequence (first transfer); a second transfer part 20 that collectively transfers the toner images transferred onto the intermediate transfer belt 15 to paper P as a recording medium (second transfer); and a fixing device 60 (example of fixing unit) that fixes the images subjected to the second transfer onto the paper P. The image forming apparatus 100 further includes a controller 40 that gives information to each device (part) or receives information from it to control the operation thereof.

A unit having the intermediate transfer belt 15, the first transfer parts 10, and the second transfer part 20 corresponds to an example of the transfer unit.

Each of the image forming units 1Y, 1M, 1C, and 1K of the image forming apparatus 100 has a photoreceptor 11 as an example of the image holding member that carries a toner image formed on the surface thereof, and the photoreceptor 11 rotates in the direction indicated by the arrow A.

In the vicinity of the photoreceptor 11, a charger 12 that is an example of the charging unit is provided to charge the photoreceptor 11, and a laser exposure unit 13 that is an example of the electrostatic charge image forming unit is provided to write an electrostatic charge image on the photoreceptor 11 (exposure beam is indicated by the sign Bm in the drawing).

Also in the vicinity of the photoreceptor 11, a developing unit 14 that includes toner of a corresponding color component is provided as an example of the developing unit to turn the electrostatic charge image on the photoreceptor 11 into a visible image with toner, and a first transfer roller 16 that transfers the toner image of a corresponding color component on the photoreceptor 11 to the intermediate transfer belt 15 at the first transfer part 10.

The above-mentioned specific toner is used as toner of at least one of the color components. In the exemplary embodiment, it is suitable that the toner of each of the color components be the specific toner.

Furthermore, a photoreceptor cleaner 17 is provided in the vicinity of the photoreceptor 11 to remove residual toner on the photoreceptor 11. The electrophotographic devices of the charger 12, laser exposure unit 13, developing unit 14, first transfer roller 16, and photoreceptor cleaner 17 are provided in sequence in the rotational direction of the photoreceptor 11. The image forming units 1Y, 1M, 1C, and 1K are disposed substantially in line in the order of yellow (Y), magenta (M), cyan (C), and black (K) from the upstream side of the intermediate transfer belt 15.

The intermediate transfer belt 15 is driven and circulates (rotates) by rollers at the intended rate in the direction denoted by the sign B in FIG. 1. Such rollers include a driving roller 31 that is driven by a motor (not illustrated) to rotate the intermediate transfer belt 15, a supporting roller 32 that supports the intermediate transfer belt 15 extending substantially in line along the direction in which the photoreceptors 11 are disposed, a tensile roller 33 that gives the intermediate transfer belt 15 tension and that functions as a correction roller that reduces meandering of the intermediate transfer belt 15, a back roller 25 provided to the second transfer part 20, and a cleaning back roller 34 provided to a cleaning part that scrapes off residual toner on the intermediate transfer belt 15.

The first transfer parts 10 each have a first transfer roller 16 as an opposite member that is disposed so as to face the photoreceptor 11 with the intermediate transfer belt 15 interposed therebetween. The first transfer roller 16 has a core and a sponge layer as an elastic layer adhering to the circumferential surface of the core. The core is a cylindrical bar made of metal such as iron or SUS. The sponge layer is formed of blended rubber of NBR, SBR, and EPDM, which contains a conductive agent such as a carbon black. The sponge layer is a cylindrical sponge roll having a volume resistivity ranging from $10^{7.5}$ Ωcm to $10^{8.5}$ Ωcm.

The first transfer roller 16 is disposed so as to be pressed against the photoreceptor 11 with the intermediate transfer belt 15 interposed therebetween, and a voltage (first transfer bias) is applied to the first transfer roller 16 in the polarity opposite to the polarity in which the toner has been charged (herein defined as negative polarity, the same holds true for the following description). Accordingly, toner images on the individual photoreceptors 11 are electrostatically drawn to the intermediate transfer belt 15 in sequence, and a composite toner image is formed on the intermediate transfer belt 15.

The second transfer part 20 has the back roller 25 and a second transfer roller 22 disposed so as to face the toner-image-carrying side of the intermediate transfer belt 15.

The surface of the back roller 25 is formed of a tube of blended rubber of EPDM and NBR in which carbon has been dispersed, and the inside thereof is formed of EPDM rubber. The back roller 25 is formed so as to have a surface resistivity ranging from $10^7$Ω/□ to $10^{10}$Ω/□, and the hardness thereof is adjusted to be, for instance, 70° (measured with ASKER Durometer Type C manufactured by Kobunshi Keiki Co., Ltd., the same holds true for the following description). The back roller 25 is disposed so as to face the back side of the intermediate transfer belt 15 and serves as a counter electrode of the second transfer roller 22, and a power-supplying roller 26 made of metal is provided in contact with the back roller 25 to steadily apply a second transfer bias.

The second transfer roller 22 has a core and a sponge layer as an elastic layer adhering to the circumferential surface of the core. The core is a cylindrical bar made of metal such as iron or SUS. The sponge layer is formed of blended rubber of NBR, SBR, and EPDM, which contains a conductive agent such as a carbon black. The sponge layer is a cylindrical sponge roller having a volume resistivity ranging from $10^{7.5}$ Ωcm to $10^{8.5}$ Ωcm.

The second transfer roller 22 is disposed so as to be pressed against the back roller 25 with the intermediate transfer belt 15 interposed therebetween. The second transfer roller 22 is grounded to form a second transfer bias between the back roller 25 and the second transfer roller 22, and thus a toner image is transferred by the second transfer to paper P (example of recording medium) that is to be transported to the second transfer part 20.

An intermediate transfer belt cleaner 35 that removes residual toner and paper dust on the intermediate transfer belt 15 after the second transfer to clean the surface thereof is provided to the intermediate transfer belt 15 downstream of the second transfer part 20 so as to be movable toward and away from the intermediate transfer belt 15.

The intermediate transfer belt 15, the first transfer parts 10 (first transfer rollers 16), and the second transfer part 20 (second transfer roller 22) correspond to an example of the transfer unit.

A reference signal sensor (home position sensor) 42 that generates a reference signal that is the basis for timing formation of images by the image forming units 1Y, 1M, 1C, and 1K is provided upstream of the image forming unit 1Y for yellow. In addition, an image density sensor 43 that adjusts image quality is provided downstream of the image forming unit 1K for black. The reference sensor 42 recognizes a mark provided on the back side of the intermediate transfer belt 15 and then generates a reference signal, and the controller 40 recognizes the reference signal and instructs the image forming units 1Y, 1M, 1C, and 1K to start formation of images.

The image forming apparatus of the exemplary embodiment has a transporting unit for transporting the paper P. The transporting unit includes a paper container 50 in which the paper P is accommodated, a paper feed roller 51 that takes out the paper P gathered in the paper container 50 at a predetermined timing to transport it, transport rollers 52 that transport the paper P taken out by the paper feed roller 51, a transport guide 53 that introduces the paper P transported by the transport rollers 52 to the second transfer part 20, a transport belt 55 that transports the paper P transported after the second transfer by the second transfer roller 22 to the fixing device 60 (example of fixing unit), and a fixing inlet guide 56 that guides the paper P to the fixing device 60.

The controller 40 is a computer that controls the whole apparatus and carries out a variety of operations. In particular, the controller 40 has, for instance, a central processing unit (CPU), a read only memory (ROM) that stores a variety of programs, a random access memory (RAM) used as a working area in execution of the programs, a nonvolatile memory that stores a variety of information, and input and output interfaces (I/O) (each not illustrated). The CPU, ROM, RAM, nonvolatile memory, and I/O are connected to each other via buses.

The image forming apparatus 100 has, in addition to the controller 40, an operation-displaying part, an image-processing part, an image memory, a storage part, and a communication part (each not illustrated). The operation-displaying part, the image-processing part, the image memory, the storage part, and the communication part are each connected to the I/O of the controller 40. The controller 40 exchanges information with the operation-displaying part, the image-processing part, the image memory, the storage part, and the communication part to control each part.

A basic process for forming an image in the image forming apparatus of the exemplary embodiment will now be described.

In the image forming apparatus of the exemplary embodiment, image data output from, for example, an image reader or personal computer (PC) (each not illustrated) is subjected to image processing with an image processor (not illustrated); and then the image forming units 1Y, 1M, 1C, and 1K perform an imaging operation.

The image processor performs image processing including shading compensation, misregistration correction, brightness/color space conversion, gamma correction, and a variety of image editing such as frame elimination, a color edit, and a moving edit on the basis of input data of reflectance. The image data subjected to the image processing is converted to colorant tone data of four colors of Y, M, C, and K and output to the laser exposure unit 13.

In the laser exposure unit 13, an exposure beam Bm emitted from, for example, a semiconductor laser is radiated to the photoreceptor 11 of each of the image forming units 1Y, 1M, 1C, and 1K on the basis of the input colorant tone data. The surfaces of the photoreceptors 11 of the image forming units 1Y, 1M, 1C, and 1K are charged with the charger 12; and the charged surfaces are subjected to scanning exposure with the laser exposure unit 13 to form electrostatic charge images. The formed electrostatic charge images are developed by the image forming units 1Y, 1M, 1C, and 1K into toner images of Y, M, C, and K, respectively.

The toner images formed on the photoreceptors 11 of the image forming units 1Y, 1M, 1C, and 1K are transferred to the intermediate transfer belt 15 at the first transfer parts 10 in which the individual photoreceptors 11 contacts with the intermediate transfer belt 15. More specifically, the first transfer is carried out in the first transfer parts 10 as follows: the first transfer rollers 16 apply voltage (first transfer bias) to the substrate of the intermediate transfer belt 15 in the polarity opposite to the polarity in which toner has been charged (negative polarity), and the toner images are placed one upon another on the surface of the intermediate transfer belt 15 in sequence.

After the toner images are sequentially subjected to the first transfer to the surface of the intermediate transfer belt 15, the intermediate transfer belt 15 moves to transport the toner images to the second transfer part 20. The transportation of the toner images to the second transfer part 20 causes the paper feed roller 51 in the transporting unit to rotate on the basis of the timing of the transportation of the toner images to the second transfer part 20, and paper P with the intended size is supplied from the paper container 50. The paper P supplied by the paper feed roller 51 is transported by the transport rollers 52 and then reaches the second transfer part 20 through the transport guide 53. Before the paper P reaches the second transfer part 20, the paper P is stopped, an alignment roller (not illustrated) rotates on the basis of the timing of the movement of the intermediate transfer belt 15 carrying the toner images to align the position of the paper P with the position of the toner images.

In the second transfer part 20, the second transfer roller 22 is pressed against the back roller 25 with the intermediate transfer belt 15 interposed therebetween. The paper P transported at the right timing enters between the intermediate transfer belt 15 and the second transfer roller 22. At this time, the power supplying roller 26 applies voltage (second transfer bias) in the polarity the same as the polarity in which toner has been charged (negative polarity), and then a transfer electric field is formed between the second transfer roller 22 and the back roller 25. The unfixed toner images carried by the intermediate transfer belt 15 is electrostatically transferred onto the paper P at one time at the second transfer part 20 at which the second transfer roller 22 and the back roller 25 are pressed against each other.

Then, the paper P having the toner images which are electrostatically transferred is transported by the second transfer roller 22 in a state in which it is separated from the intermediate transfer belt 15 and reaches the transport belt 55 provided downstream of the second transfer roller 22 in the direction in which the paper is transported. The transport belt 55 transports the paper P to the fixing device 60 at the optimum transport rate for the fixing device 60. The unfixed toner images on the paper P transported to the fixing device 60 are fixed onto the paper P with heat and pressure in the fixing device 60. The paper P having the fixed image is transported to an ejected paper holder (not illustrated) provided to an ejection part of the image forming apparatus.

After the transfer to the paper P is finished, residual toner on the intermediate transfer belt 15 is transported to the cleaning part by the rotation of the intermediate transfer belt 15 and then removed from the intermediate transfer belt 15 with the cleaning back roller 34 and the intermediate transfer belt cleaner 35.

Fixing Unit

The fixing unit used in the image forming apparatus of the exemplary embodiment will now be described in detail.

The fixing unit used in the exemplary embodiment includes a fixing belt that comes into contact with a toner image transferred to a recording medium, a rotational member that is disposed in contact with the outer surface of the fixing belt such that a contact area is formed between the rotational member and the fixing belt, and a heat source that is disposed so as to face the inner surface of the fixing belt to directly heat the fixing belt; and a recording medium having a transferred toner image passes through the contact area to fix the toner image to the recording media.

In addition to the fixing belt, the rotational member, and the heat source, the fixing unit may include any of known members that can be used in the fixing unit.

The fixing unit may, for example, include a contact-area-forming member that is disposed so as to face the inner surface of the fixing belt and that contacts with the rotational member with the fixing belt interposed therebetween to form the contact area between the fixing belt and the rotational member, a support member that supports the contact-area-forming member, a low-friction member that is disposed at the part at which the contact-area-forming member contacts with the inner surface of the fixing belt, a reflection member that reflects heat radiated from the heat source to the fixing belt, a temperature detecting unit that detects the temperature of the fixing belt, and a pressing unit that presses the rotational member toward the fixing belt.

An example of the fixing unit will now be described with reference to the fixing device 60 illustrated in FIG. 2. The fixing unit is not limited to the example illustrated in FIG. 2.

Figure 2:
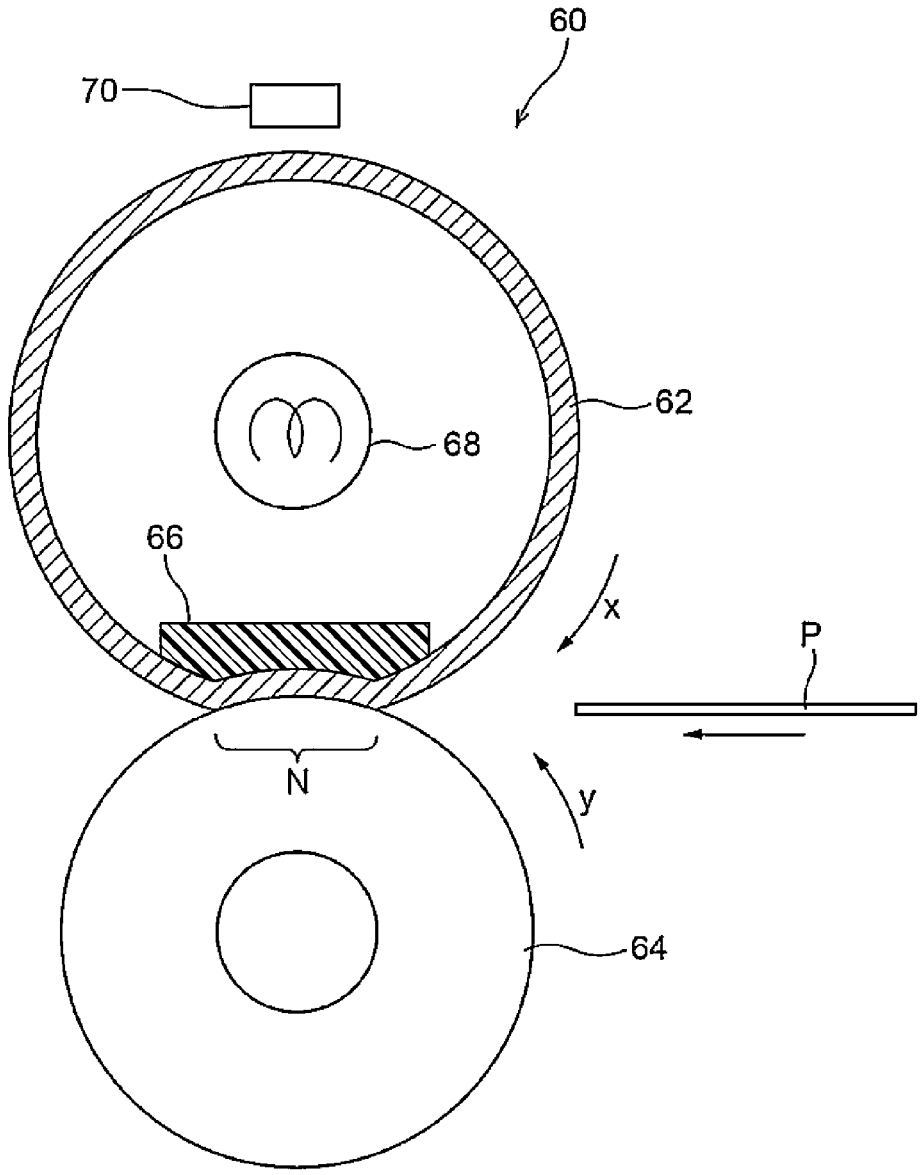
FIG. 2 schematically illustrates an example of the structure of a fixing device according to the exemplary embodiment.

FIG. 2 schematically illustrates an example of the structure of the fixing device.

The fixing device 60 includes a fixing belt 62, a pressure roller 64 (example of rotational member), a pad 66 (example of contact-area-forming member), a halogen lamp 68 (example of heat source), and a temperature sensor 70 (example of temperature detecting unit) as illustrated in FIG. 2.

The outer surface of the fixing belt 62 is in contact with the outer surface of the pressure roller 64 to form a contact area N. Both the fixing belt 62 and the pressure roller 64 rotate to transport paper P and also fix a toner image to the surface of the paper P in the contact area N.

The fixing belt 62 contacts with a toner image transferred to the surface of the paper P.

An insertion member (not illustrated) is attached to each of the two ends of the fixing belt 62 to maintain the shape of the fixing belt 62, and the fixing belt 62 is held by this insertion member so as to be rotatable in the direction x in FIG. 2.

The fixing belt 62 is suitably a thin and flexible endless belt in order to reduce heat capacity. The term "endless belt" herein refers to a belt of which the two ends have been joined together without a seam.

The thickness of the fixing belt 62 (namely, total thickness) is preferably from 130 μm to 1000 μm, more preferably from 130 μm to 200 μm, and further preferably from 130 μm 160 μm in order to reduce heat capacity.

The diameter (outer diameter) of the fixing belt 62 is preferably from 15 mm to 120 mm and more preferably from 20 mm to 40 mm in order to give reduce heat capacity.

An example of the fixing belt 62 is an endless belt having a belt-shaped substrate, an elastic layer formed on the substrate, and a release layer formed on the elastic layer.

The fixing belt 62 does not necessarily have the elastic layer and the release layer.

Examples of the material for forming the substrate of the fixing belt 62 includes, but are not limited to, metal materials, such as nickel and SUS, and resin materials such as polyimide.

The thickness of the substrate of the fixing belt 62 is, for instance, suitably from 20 μm to 50 μm.

Examples of a material for forming the elastic layer of the fixing belt 62 includes, but are not limited to, rubber materials such as silicone rubber, foaming silicone rubber, and fluororubber.

The thickness of the elastic layer of the fixing belt 62 is, for instance, suitably from 100 μm to 300 μm.

Examples of the material for forming the release layer of the fixing belt 62 include, but are not limited to, fluororesins, such as a tetrafluoroethylene-perfluoroalkyl vinyl ether copolymer (PFA) and polytetrafluoroethylene (PTFE), polyimide, polyetherimide, and polyether sulfide (PES).

The thickness of the release layer of the fixing belt 62 is, for instance, suitably from 10 μm to 50 μm.

The pressure roller 64 is a rotational member that is disposed in contact with the outer surface of the fixing belt 62 to form the contact area N between the pressure roller 64 and the fixing belt 62.

Part of the outer surface of the pressure roller 64 is pushed by a pressing member (example of a pressing unit that presses the pressure roller 64 toward the fixing belt 62, not illustrated) toward the fixing belt 62 and therefore pressed against the pad 66 with the fixing belt 62 interposed therebetween. This structure enables formation of the contact area N (namely, nip) between the pressure roller 64 and the fixing belt 62.

In other words, the pressure roller 64 and the pad 66 nip the fixing belt 62 in the contact area N to apply pressure thereto.

The total load applied to the contact area N between the pressure roller 64 and the fixing belt 62 is suitably from 22 N to 30 N, and the length of the contact area N along the transport direction of the recording medium (nip width in other words) is suitably from 8.0 mm to 10.0 mm.

Since the fixing device 60 has such a contact area N, the amount of a release agent that comes out of the specific toner is likely to be controlled to be within an appropriate range; thus, the occurrence of the difference in the quality of a fixed image between the top side and the back side is likely to be reduced in double-sided printing.

The length of the contact area N along the transport direction of the recording medium (nip width) refers to the distance of the contact area N (distance in which the pressure roller 64 and the fixing belt 62 are in contact with each other in the circumferential direction thereof).

The total load applied to the contact area N is more suitably from 24N to 28 N.

The length of the contact area N along the transport direction of a recording medium is more suitably from 8.5 mm to 9.5 mm.

The total load applied to the contact area N can be, for example, measured with a surface pressure distribution measuring system (TACTILE) manufactured by Nitta Corporation.

The pressure roller 64 is rotationally driven by a driving mechanism (not illustrated) in the direction denoted by the arrow y.

Once the pressure roller 64 is rotationally driven, its driving force is transmitted to the fixing belt 62 in the contact area N to force the fixing belt 62 to rotate.

An example of the pressure roller 64 is a roller having a cylindrical or columnar core, an elastic layer formed on the core, and a release layer formed on the elastic layer.

The pressure roller 64 does not necessarily have the release layer.

The diameter of the pressure roller 64 is, for example, approximately 30 mm.

The core of the pressure roller 64 may be cylindrical or columnar.

In the case where the core is cylindrical, a heat source, such as a halogen heater, may be provided inside the cylindrical core.

Examples of a material for forming the elastic layer of the pressure roller 64 includes, but are not limited to, rubber materials such as silicone rubber, foaming silicone rubber, and fluororubber.

Examples of the material for forming the release layer of the pressure roller 64 include, but are not limited to, a tetrafluoroethylene-perfluoroalkyl vinyl ether copolymer (PFA) and polytetrafluoroethylene (PTFE).

The pad 66 is disposed so as to face the inner surface of the fixing belt 62 and in indirect contact with the pressure roller 64 with the fixing belt 62 interposed therebetween to form the contact area N between the fixing belt 62 and the pressure roller 64.

Since the pressure roller 64 is pressed against the pad 66 with the fixing belt 62 interposed therebetween, the pad 66 and the pressure roller 64 nips the fixing belt 62 in the contact area N to apply pressure.

The length of the pad 66 extends, for example, in the axial direction of the fixing belt 62 (direction of rotational axis of belt), and the pad 66 is fixed and supported by a support member (not illustrated).

The pad 66 is fixed to the insertion members attached to both the ends of the fixing belt 62 via the support member.

The support member is, for example, formed of a metal material such as stainless steel or iron, and the surface thereof may be subjected to a heat insulating treatment or specular working.

The pad 66 may have any shape provided that it enables formation of the contact area N along the axial direction of the fixing belt 62.

The pad 66 is, for example, a planar member having a length that extends the axial direction of the fixing belt 62; alternatively, it may be a member having a recessed cross-sectional surface.

Examples of a material for forming the pad 66 include heat-resistant resins such as polyether sulfone, polyphenylene sulfide, liquid crystal polymers, polyether nitrile, polyamide imide, polyether ether ketone, and polyimide.

Although not illustrated in FIG. 2, a low-friction sheet (example of low-friction member) may be provided between the pad 66 and the fixing belt 62.

Examples of the low-friction sheet include friction-resistant slidable sheets such as a mesh-like sheet within which polytetrafluoroethylene (PTFE) fibers are woven and a TEFLON (registered trademark) sheet.

The halogen heater 68 is disposed so as to face the inner surface the fixing belt 62 and directly heats the fixing belt 62 with radiant heat.

The two ends of the halogen heater 68 are individually fixed to the main body (not illustrated) of the fixing device 60.

The halogen heater 68 emits heat under the control of output power by the controller of the image forming apparatus (for example, controller 40 in FIG. 1). The temperature sensor 70, which will be described later, detects the surface temperature of the fixing belt 62, and the control of output power is carried out on the basis of the result of the detection.

The control of the output power of the halogen heater 68 enables the surface temperature of the fixing belt 62 (namely, fixing temperature) to be adjusted to the intended level.

The halogen heater 68 is, for instance, in the form of a circular tube extending along the width direction of the fixing belt 62 (direction of the rotational axis of the belt).

Any of known heat sources that can directly heat the fixing belt 62 may be used in place of the halogen heater 68. Examples of the known heat sources include ceramic heaters, carbon heaters, and heaters involving induction heating (IH).

The fixing device 60 illustrated in FIG. 2 includes a single halogen heater 68; however, the fixing device 60 may include multiple (such as two or three) heat sources, such as halogen heaters 68, in order to heat the fixing belt 62 with higher accuracy.

The temperature sensor 70 is disposed so as to face the outer surface of the fixing belt 62 to detect the surface temperature of the fixing belt 62.

Examples of the temperature sensor 70 include a thermistor and a thermocouple.

An example of the operation of the fixing device will now be described with reference to FIG. 2.

Once the image forming apparatus itself is turned on, electric power is supplied to the halogen heater 68; then, the fixing belt 62 starts to be heated, and the pressure roller 64 starts to be rotationally driven in the direction denoted by the arrow y. This mechanism forces the fixing belt 62 to be driven in the direction denoted the arrow x owing to the frictional force generated between the fixing belt 62 and the pressure roller 64.

The halogen heater 68 may start heating the fixing belt 62 at the same time as or at a time interval from the beginning of the rotational driving of the pressure roller 64.

The paler P having an unfixed toner image is subsequently guided by a fixing inlet guide (fixing inlet guide 56 in FIG. 1) and transported in the direction denoted by the arrow in FIG. 2. Then, the paper P is inserted into the contact area N between the fixing belt 62 and the pressure roller 64.

The toner image is fixed to the surface of the paper P by the heat of the fixing belt 62, which has been heated by the halogen heater 68, and pressure applied between the fixing belt 62 and the pressure roller 64.

The paper P having a fixed toner image is transported out of the contact area N.

In this process, the front end of the paper P contacts with an end of a separation member (not illustrated), so that the paper P is separated from the fixing belt 62.

The separated paper P is subsequently ejected to the outside of the image forming apparatus by an ejection roller (not illustrated) and stacked on a paper exit tray.

In this process, the temperature sensor 70 in the fixing device 60 detects temperature, and the heating by the halogen heater 68 is controlled on the basis of the detected temperature so that the contact area N is at a predetermined temperature (namely, fixing temperature).

The heating by the halogen heater 68 increases the temperature of the contact area N to a degree necessary for the fixing, and then the insertion of the paper P into the contact area N is started.

Electrostatic Charge Image Developer

An electrostatic charge image developer (also simply referred to as "developer") accommodated in the developing unit of the image forming apparatus according to the exemplary embodiment will now be described in detail.

The developer used in the exemplary embodiment at least contains a toner (specific toner) that has a temperature $T_1$ at a storage modulus G' of $1\times10^8$ Pa and a temperature $T_2$ at a storage modulus G' of $1\times10^6$ Pa and that satisfies the conditions 1 and 2.

The developer may be a single component developer containing only toner including the specific toner or may be a two component toner containing both toner including the specific toner and a carrier.

It is suitable that the whole toner contained in the developer be the specific toner; however, another toner different from the specific toner may be used in an amount of 10 mass % or less relative to the whole toner.

Specific Toner

The specific toner has a temperature $T_1$ at a storage modulus G' of $1\times10^8$ Pa and a temperature $T_2$ at a storage modulus G' of $1\times10^6$ Pa and satisfies the conditions 1 and 2.

$$1.215 \leq T_2/T_1 \leq 1.365 \quad \text{Condition 1:}$$

$$50^\circ\text{ C.} \leq T_1 \leq 68^\circ\text{ C.} \quad \text{Condition 2:}$$

The condition 1 is suitably a condition 1' of $1.220 \leq T_2/T_1 \leq 1.360$.

The condition 2 is suitably a condition 2' of $52^\circ\text{ C.} \leq T_1 \leq 66^\circ\text{ C.}$ The storage modulus G' is measured with a rheometer (viscoelasticity meter).

In particular, the storage modulus G' is measured with a rheometer ARES manufactured by TA Instruments; specifically, a toner to be analyzed is place on a sample holder having a diameter of 8 mm, and the storage modulus G' is measured at a temperature increase rate of 1° C./min, a frequency of 1 Hz, a distortion of 1% or less, and detected torque within the range of the value of measurement assurance. A standard software of the rheometer (viscoelasticity meter) is used for the analysis.

Through such a measurement, the data of a change in the storage modulus G' to a temperature change is obtained. From the obtained data, the temperature $T_1$ at a storage modulus G' of $1\times10^8$ Pa and the temperature $T_2$ at a storage modulus G' of $1\times10^6$ Pa are determined.

The toner satisfying the conditions 1 and 2 are, for example, produced through the following methods.

(1) A method of controlling the relationship between the glass transition temperature of an amorphous resin and the melting temperature of a release agent in the toner particles of the toner (2) A method of controlling the shape of a release agent used in the toner particles of the toner (3) A method of controlling the structure or position of a release agent used in the toner particles of the toner.

The method of controlling the relationship between the glass transition temperature of an amorphous resin and the melting temperature of a release agent in the toner particles of the toner will now be described.

In this method, the relationship between the glass transition temperature (Tg) of the amorphous resin and the melting temperature of the release agent in the toner particles is controlled, so that the toner satisfying the conditions 1 and 2 are likely to be produced.

Specifically, in the case where the specific toner contains toner particles containing an amorphous resin and a release agent, the difference between the glass transition temperature of the amorphous resin used in the toner particles and the melting temperature of the release agent used in the toner particles is suitably controlled. The difference is preferably from 10° C. to 40° C., and more preferably from 13° C. to 37° C.

Such a difference between the glass transition temperature of the amorphous resin used in the toner particles and the melting temperature of the release agent used in the toner particles can be appropriately changed by adjusting a combination of the amorphous resin and the release agent in production of the toner particles.

The method of controlling the shape of a release agent used in the toner particles of the toner will now be described.

In this method, the shape of the release agent used in the toner particles is controlled, so that the toner satisfying the conditions 1 and 2 are likely to be produced.

Specifically, in the case where the specific toner has toner particles containing a binder resin and a release agent, the shape of the release agent used in the toner particles (namely, aspect ratio of domain) and the distribution thereof are suitably controlled. In particular, the shape of the release agent and the distribution thereof are suitably as follows.

That is, the release agent forms domains inside the toner particles, and the mode and the skewness in the number frequency distribution of the aspect ratio of the domains (also referred to as "release agent domain") are suitably from 1.10 to 1.50 and from 1.05 to 1.30, respectively.

The term "aspect ratio of the release agent domains" refers to a value obtained by dividing the maximum length of the release agent domain by a diagonal width (namely, value of maximum length/diagonal width), and the term "diagonal width" refers to the shortest distance between two straight lines defined so as to be in parallel with the maximum length and in contact with the release agent domains.

When the mode and skewness in the number frequency distribution of the aspect ratio of the release agent domains are within such ranges, the release agent domains with a large aspect ratio exist to some extent among more release agent domains with a small aspect ratio, and such release agent domains with a large aspect ratio are distributed in the manner of a reverse taper from the mode to the side of a larger aspect ratio.

Specifically, the proportion of the release agent domains with an aspect ratio ranging from 1.10 to 1.50 is suitably from 20 number % to 40 number % relative to all of the release agent domains, the proportion of the release agent domains with an aspect ratio greater than 1.5 and less than or equal to 2.0 is suitably from 10 number % to 20 number % relative to all of the release agent domains, and the proportion of the release agent domains with an aspect ratio greater than 2.0 and less than or equal to 3.0 is suitably from 6 number % to 10 number % relative to all of the release agent domains.

It is believed that such a number frequency distribution of the aspect ratio of the release agent domains has the following effect.

In particular, in the first fixing process in double-sided printing (fixing of an image to the first side of a recording medium), the release agent quickly comes out of the release agent domains with a large aspect ratio and contributes to separability from the fixing belt. In this case, the release agent domains with a small aspect ratio remain inside the fixed image formed on the first side of a recording medium.

In the second fixing process in double-sided printing (fixing of an image to the second side of the recording medium that is opposite to the first side), the pressure roller (example of rotational member) contacts with the fixed image formed on the first side of the recording medium. Hence, even in the case where overshoot occurs and where heat is applied to the fixed image formed on the first side of the recording medium being in contact with the pressure roller, the release agent comes out of the release agent domains with a small aspect ratio remaining inside the fixed image, which gives separability between the fixed image and the pressure roller. Thus, the re-melting of the fixed image formed on the first side of the recording medium is reduced, which enables a reduction in the adhesion of this fixed image to the pressure roller.

Consequently, the occurrence of image defects due to the re-melting of a fixed image is reduced in double-sided printing.

The mode in the number frequency distribution of the aspect ratio of the release agent domain is preferably from 1.10 to 1.50, and more preferably from 1.15 to 1.45. The skewness is preferably from 1.05 to 1.30, and more preferably from 1.10 to 1.25.

Methods for identifying the release agent domains of the toner particles and for observing the aspect ratio will now be described.

The release agent domains in the toner particles can be observed, for instance, by a technique of observing the cross-sectional surfaces of the toner particles with a transmission electron microscope or a technique of dying the cross-sectional surfaces of the toner particles with ruthenium tetroxide and observing the cross-sectional surfaces with a scanning electron microscope.

The observation with a scanning electron microscope is suitable because it enables clear observation of the release agent domains on the cross-sectional surfaces of the toner particles. Any scanning electron microscope well known by those skilled in the art can be used, and examples thereof include SU8020 manufactured by Hitachi High-Technologies Corporation and JSM-7500F manufactured by JEOL Ltd.

A specific observation method is as follows.

Toner particles to be analyzed are embedded into an epoxy resin, and the epoxy resin is cured. The cured epoxy resin is cut into slices with a microtome having a diamond blade to produce an observation sample in which the cross-sectional surfaces of the toner particles are exposed. The slice of the observation sample is dyed with ruthenium tetroxide, and the cross-sectional surfaces of the toner particles are observed with a scanning electron microscope (SEM) (SEM image is observed). In this method, the difference in the degree of dying enables observation of release agent domains having a luminance difference (contrast) in a continuous phase (matrix) containing the binder resin on the cross-sectional surfaces of the toner particles.

A method for determining the aspect ratio will now be described.

In the above-mentioned method for observing the release agent domains, an SEM image is obtained in such a magnification that the cross-sectional surface of one toner particle is in the field of view. The obtained SEM image is analyzed with an image analyzing software (WinROOF manufactured by MITANI CORPORATION) at 0.010000 μm/pixel. Through this image analysis, the maximum length and diagonal width of the release agent domains in the toner particles are determined, and the aspect ratio is calculated.

A method for determining the mode in the number frequency distribution of the aspect ratio of the release agent domains will now be described.

The above-mentioned calculation of the aspect ratio of the release agent domains is carried out for 200 toner particles.

The obtained data of the aspect ratio of the release agent domains is statistically analyzed at each data interval of 0.01 from 0 to determine the number frequency distribution of the aspect ratio. The mode of the obtained number frequency distribution, namely the value of the data interval that most frequently appears in the number frequency distribution of the aspect ratio of the release agent domains, is determined. The value of this data interval is defined as the mode in the number frequency distribution of the aspect ratio of the release agent domains.

A method for determining the skewness in the number frequency distribution of the aspect ratio of the release agent domains will now be described.

The number frequency distribution of the aspect ratio of the release agent domains is determined in the manner described above. From this number frequency distribution, the skewness is determined on the basis of the below equation.

In the equation, the skewness is Sk, the number of data of the number frequency distribution of the aspect ratio of the release agent domains is n, the value of the data of the number frequency distribution of the aspect ratio of the release agent domains is $x_i$ (i=1, 2, . . . , n), the average of the whole data of the number frequency distribution of the aspect ratio of the release agent domains is x (x with a bar above), and the standard deviation of the whole data of the number frequency distribution of the aspect ratio of the release agent domains is s.

$$Sk = \frac{n}{(n-1)(n-2)} \sum_{i=1}^{n} \left( \frac{x_i - \bar{x}}{s} \right)^3$$

A method for producing toner particles in which the mode and the skewness in the number frequency distribution of the aspect ratio of the release agent domains are within the above-mentioned ranges will be described in the section "Production of Toner".

Toner

The basic structure of the toner including the specific toner will now be described.

The toner contains toner particles. The toner may contain an external additive in addition to the toner particles.

Toner Particles

The toner particles contain, for example, a binder resin and a release agent. The toner particles may optionally contain a colorant and another additive.

Binder Resin

The binder resin to be used may be either a crystalline resin and an amorphous resin.

The amorphous resin herein does not show a clear endothermic peak but show only a step-like endothermic change in a thermal analysis by differential scanning calorimetry (DSC) and that is a solid at normal temperature and thermoplasticized at the glass transition temperature or higher.

In contrast, a crystalline resin does not show a step-like change in the amount of endothermic energy but show a clear endothermic peak in an analysis by differential scanning calorimetry (DSC).

Specifically, for example, the half-value width of the endothermic peak of the crystalline resin is within 10° C. when the analysis is performed at a temperature increase rate of 10° C./min, and the amorphous resin has the half-value width exceeds 10° C. or does not have a clear endothermic peak.

Examples of the type of the binder resin include vinyl resins that are homopolymers of monomers such as styrenes (such as styrene, p-chlorostyrene, and α-methylstyrene), (meth)acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene) or copolymers of two or more of these monomers.

Other examples of the type of the binder resin include, in addition to the above-mentioned vinyl resins, non-vinyl resins such as epoxy resins, polyester resins, polyurethane resins, polyamide resins, cellulose resins, polyether resins, and modified rosin; mixtures thereof with the above-mentioned vinyl resins; and graft polymers obtained by polymerization of a vinyl monomer in the coexistence of such non-vinyl resins.

Suitable examples of the type of the binder resin include polyester resins and styrene-acrylic resins that are copolymers at least containing styrenes and (meth)aclyrates.

The term "(meth)acryl" comprehensively refers to both "acryl" and "methacryl".

Polyester resins and styrene-acrylic resins that are suitable as the binder resin will now be described.

Polyester Resin

Examples of the suitable polyester resin as the binder resin include known amorphous polyester resins.

Examples of the amorphous polyester resin include polycondensates of a polycarboxylic acid with a polyhydric alcohol.

The amorphous polyester resin may be a commercially available product or may be a synthesized resin.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenylsuccinic acid, adipic acid, and sebacic acid); alicyclic dicarboxylic acids (such as cyclohexanedicarboxylic acid); aromatic dicarboxylic acids (such as terephthalic acid, isophthalic acid, phthalic acid, and naphthalenedicarboxylic acid); anhydrides of the foregoing; and lower alkyl esters (having, for example, from 1 to 5 carbon atoms) of the foregoing. Of these, for example, aromatic dicarboxylic acids are suitable as the polycarboxylic acid.

The polycarboxylic acid may be a combination of the dicarboxylic acid with a carboxylic acid that has three or more carboxy groups and that gives a cross-linked structure or a branched structure. Examples of the carboxylic acid having three or more carboxy groups include trimellitic acid and pyromellitic acid, anhydrides of the foregoing, and lower alkyl esters (having, for example, from 1 to 5 carbon atoms) of the foregoing.

Such polycarboxylic acids may be used alone or in combination.

Examples of the polyhydric alcohol include aliphatic diols (such as ethylene glycol, diethylene glycol, triethylene glycol, propylene glycol, butanediol, hexanediol, and neopentyl glycol); alicyclic diols (such as cyclohexanediol, cyclohexanedimethanol, and hydrogenated bisphenol A); and aromatic diols (such as ethylene oxide adducts of bisphenol A and propylene oxide adducts of bisphenol A). Among these, for example, aromatic diols and alicyclic diols are preferred as the polyhydric alcohol, and aromatic diols are more preferred.

The polyhydric alcohol may be a combination of the diol with a polyhydric alcohol that has three or more hydroxy groups and that gives a cross-linked structure or a branched structure. Examples of the polyhydric alcohol having three or more hydroxy groups include glycerin, trimethylolpropane, and pentaerythritol.

Such polyhydric alcohols may be used alone or in combination.

Alkylene oxide adducts of bisphenol A (such as ethylene oxide adduct of bisphenol A, propylene oxide adduct of bisphenol A, and ethylene oxide-propylene oxide adduct of bisphenol A) are not used as the polyhydric alcohol or used in a slight amount if any. Specifically, in the case where an alkylene oxide adduct of bisphenol A is used, the amount thereof is greater than 0 mol % but not more than 5 mol % relative to the amount of the whole polyhydric alcohol.

The amorphous polyester resin has a glass transition temperature (Tg) ranging preferably from 50° C. to 80° C., and more preferably from 50° C. to 65° C.

The glass transition temperature of the resin is herein determined from a DSC curve obtained by differential scanning calorimetry (DSC) and can be specifically determined in accordance with "Extrapolated Starting Temperature of Glass Transition" described in determination of glass transition temperature in JIS K 7121-1987 "Testing Methods for Transition Temperatures of Plastics".

The amorphous polyester resin has a weight average molecular weight (Mw) ranging preferably from 5000 to 1000000, more preferably from 7000 to 500000, and further preferably from 30000 to 50000.

The amorphous polyester resin suitably has a number average molecular weight (Mn) ranging from 2000 to 100000.

The amorphous polyester resin has a molecular weight distribution Mw/Mn ranging preferably from 1.5 to 100, and more preferably from 2 to 60.

The weight average molecular weight and number average molecular weight of the resin are herein measured by gel permeation chromatography (GPC). The measurement of the molecular weight by GPC involves using a measurement apparatus that is GPC•HLC-8120GPC manufactured by Tosoh Corporation, a column that is TSK gel Super HM-M (15 cm) manufactured by Tosoh Corporation, and a tetrahydrofuran (THF) solvent. From results of such measurement, the weight average molecular weight and the number average molecular weight are calculated from a molecular weight calibration curve plotted on the basis of a standard sample of monodisperse polystyrene.

The amorphous polyester resin can be produced by any of known techniques. In particular, the amorphous polyester resin is, for example, produced through a reaction at a polymerization temperature ranging from 180° C. to 230° C. optionally under reduced pressure in the reaction system, while water or alcohol that is generated in condensation is removed.

In the case where monomers as the raw materials are not dissolved or compatible at the reaction temperature, a solvent having a high boiling point may be used as a solubilizing agent in order to dissolve the raw materials. In such a case, the polycondensation reaction is performed while the solubilizing agent is distilled away. In the case where monomers having low compatibility are used, such monomers are preliminarily subjected to condensation with an acid or alcohol that is to undergo polycondensation with the monomers, and then the resulting product is subjected to polycondensation with the principle components.

In the case where the amorphous polyester resin is used as the binder resin, the amount of the amorphous polyester resin is preferably from 60 mass % to 98 mass %, more preferably from 70 mass % to 98 mass %, and further preferably from 80 mass % to 98 mass % relative to the amount of the whole binder resin.

The amorphous polyester resin may be used in combination with a crystalline resin as the binder resin.

The combined use of a crystalline resin enables the moisture absorption of the toner particles to be lowered and thus leads to an easy reduction in generation of a distorted image due to scattering of the toner.

The amount of a crystalline resin to be used may be in the range of 2 mass % to 40 mass % (suitably 2 mass % to 20 mass %) relative to the amount of the whole binder resin.

Examples of the crystalline resin include known crystalline resins such as crystalline polyester resins and crystalline vinyl resins (such as polyalkylene resin and long-chain alkyl(meth)acrylate resin). Among these, crystalline polyester resins are suitable in terms of a reduction in generation of a distorted image due to scattering of the toner.

Examples of the crystalline polyester resin include polycondensates of a polycarboxylic acid with a polyhydric alcohol. The crystalline polyester resin may be a commercially available product or a synthesized resin.

The crystalline polyester resin may be suitably a polycondensate prepared from polymerizable monomers having linear aliphatics rather than a polycondensate prepared from polymerizable monomers having aromatics in terms of easy formation of a crystal structure.

Examples of the polycarboxylic acid include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid); aromatic dicarboxylic acids (e.g., dibasic acids such as phthalic acid, isophthalic acid, terephthalic acid, and naphthalene-2,6-dicarboxylic acid); anhydrides of these dicarboxylic acids; and lower alkyl esters (having, for example, from 1 to 5 carbon atoms) of these dicarboxylic acids.

The polycarboxylic acid may be a combination of the dicarboxylic acid with a carboxylic acid that has three or more carboxy groups and that gives a cross-linked structure or a branched structure. Examples of the carboxylic acid having three carboxy groups include aromatic carboxylic acids (such as 1,2,3-benzenetricarboxylic acid, 1,2,4-benzenetricarboxylic acid, and 1,2,4-naphthalenetricarboxylic acid); anhydrides of these tricarboxylic acids; and lower alkyl esters (having, for example, from 1 to 5 carbon atoms) of these tricarboxylic acids.

The polycarboxylic acid may be a combination of these dicarboxylic acids with a dicarboxylic acid having a sulfonic group or a dicarboxylic acid having an ethylenic double bond.

The polycarboxylic acids may be used alone or in combination.

Examples of the polyhydric alcohol include aliphatic diols (such as linear aliphatic diols having a backbone with from 7 to 20 carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol are suitable.

The polyhydric alcohol may be a combination of the diol with an alcohol that has three or more hydroxy groups and that gives a cross-linked structure or a branched structure. Examples of the alcohol having three or more hydroxy groups include glycerin, trimethylolethane, trimethylolpropane, and pentaerythritol.

The polyhydric alcohols may be used alone or in combination.

The aliphatic diol content in the polyhydric alcohol may be 80 mol % or more, and suitably 90 mol % or more.

The melting temperature of the crystalline polyester resin is preferably from 50° C. to 100° C., more preferably from 55° C. to 90° C., and further preferably from 60° C. to 85° C.

The melting temperature is determined from a DSC curve obtained by differential scanning calorimetry (DSC) in accordance with "Melting Peak temperature" described in determination of melting temperature in JIS K 7121-1987 "Testing Methods for Transition Temperatures of Plastics".

The weight average molecular weight (Mw) of the crystalline polyester resin is suitably from 6,000 to 35,000.

The crystalline polyester resin can be, for example, produced by any of known techniques as in production of the amorphous polyester resin.

The amount of the crystalline resin (suitably crystalline polyester resin) is preferably from 3 mass to 20 mass %, and more preferably from 5 mass to 15 mass relative to the amount of the whole toner particles. The amount of the crystalline resin in such a range enables an easy reduction in generation of a distorted image due to scattering of the toner particles.

In the case where the amorphous polyester resin and the crystalline resin are used as the binder resin, another resin different therefrom may be used in combination.

The amount of such another resin is suitably 10 mass % or less relative to the amount of the whole binder resin.

Styrene-Acrylic Resin

Suitable styrene-acrylic resin as the binder resin will now be described.

Examples of the styrene-acrylic resin include copolymers produced by at least copolymerization of styrenes with (meth)acrylates. The styrene-acrylic resin may be copolymers produced by polymerization of styrenes with (meth) acrylates and other monomers.

The styrenes are monomers having a styrene skeleton. Specific examples thereof include styrene; vinylnaphthalene; alkyl-substituted styrenes such as α-methylstyrene, o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; aryl-substituted styrenes such as p-phenylstyrene; alkoxy-substituted styrenes such as p-methoxystyrene; halogen-substituted styrenes such as p-chlorostyrene and 3,4-dichlorostyrene; nitro-substituted styrenes such as m-nitrostyrene, o-nitrostyrene, and p-nitrostyrene; and 4-fluorostyrene, 2,5-difluorostyrene, and fluorine-substituted styrenes. Among these styrenes, styrene, p-ethylstyrene, and p-n-butylstyrene are suitable.

These styrenes may be used alone or in combination.

The (meth)acrylates are monomers having a structure in which (meth)acrylic acid has been esterified. Specific examples of the (meth)acrylates include alkyl (meth)acrylates such as n-methyl (meth)acrylate, n-ethyl (meth)acrylate, n-propyl (meth)acrylate, n-butyl (meth)acrylate, n-pentyl (meth)acrylate, n-hexyl (meth)acrylate, n-heptyl (meth) acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth) acrylate, amyl (meth)acrylate, neopentyl (meth)acrylate, isohexyl (meth)acrylate, isoheptyl (meth)acrylate, isooctyl (meth)acrylate, 2-ethylhexyl (meth)acrylate, octyl (meth) acrylate, decyl (meth)acrylate, lauryl (meth)acrylate, and stearyl (meth)acrylate;

carboxy-substituted alkyl (meth)acrylates such as β-carboxyethyl (meth)acrylate;

hydroxy-substituted alkyl (meth)acrylates such as 2-hydroxyethyl (meth)acrylate, 2-hydroxypropyl (meth)acrylate, 3-hydroxypropyl (meth)acrylate, 2-hydroxybutyl (meth) acrylate, 3-hydroxybutyl (meth)acrylate, and 4-hydroxybutyl (meth)acrylate; and alkoxy-substituted alkyl (meth)acrylates such as 2-methoxyethyl (meth)acrylate.

Among these (meth)acrylates, alkyl (meth)acrylates with an alkyl group having from 2 to 14 carbon atoms (preferably from 2 to 10 carbon atoms, and more preferably from 3 to 8 carbon atoms) are suitable in terms of the fixability of the toner.

Such (meth)acrylates may be used alone or in combination.

Examples of other monomers include (meth)acrylates; ethylenically unsaturated nitriles (such as acrylonitrile and methacrylonitrile); vinyl ethers (such as vinyl methyl ether and vinyl isobutyl ether); vinyl ketones (such as vinyl methyl ketone, vinyl ethyl ketone, and vinyl isopropenyl ketone); divinyls (such as divinyl adipate); olefins (such as ethylene, propylene, and butadiene); thiols (such as dodecanthiol); and dicarboxylic acids (such as decanediol acrylate).

In the styrene-acrylic resin, the content proportion of the styrenes is suitably 60 mass or more, preferably from 65 mass % to 90 mass %, and more preferably from 70 mass % to 85 mass % relative to the whole polymeric components in terms of image storability.

The content proportion of the (meth)acrylates is suitably from 10 mass % to 40 mass %, and preferably from 10 mass % to 35 mass %, relative to the whole polymeric components in terms of toner fixability.

The glass transition temperature (Tg) of the styrene-acrylic resin is preferably from 45° C. to 80° C., more preferably from 45° C. to 65° C.

The styrene-acrylic resin has a weight average molecular weight (Mw) ranging preferably from 5000 to 700000, and more preferably from 7000 to 300000.

The styrene-acrylic resin suitably has a number average molecular weight (Mn) ranging from 2000 to 100000.

The styrene-acrylic resin has a molecular weight distribution Mw/Mn ranging preferably from 1.0 to 100, and more preferably from 1.2 to 50.

The styrene-acrylic resin can be synthesized by known polymerization methods (radical polymerization such as emulsion polymerization and solution polymerization).

The styrene-acrylic resin may be synthesized in the form of resin particles by emulsion polymerization.

In the case where the styrene-acrylic resin is used as the binder resin, another resin different from the styrene-acrylic resin may be used in combination.

The amount of the styrene-acrylic resin may be 60 mass % or more (suitably 80 mass % or more) relative to the whole binder resin.

Such another resin can be binder resins different from the styrene-acrylic resin; and examples thereof include aspect ratio vinyl resins and non-vinyl resins such as epoxy resins, polyester resins, polyurethane resins, polyamide resins, cellulose resins, polyether resins, and modified rosin The amount of the binder resin is, for instance, preferably from 40 mass % to 95 mass %, more preferably from 50 mass % to 90 mass %, and further preferably from 60 mass % to 85 relative to the whole toner particles.

Colorant

Examples of the colorant include a variety of pigments, such as carbon black, chrome yellow, Hansa Yellow, benzidine yellow, indanthrene yellow, quinoline yellow, pigment yellow, permanent orange GTR, pyrazolone Orange, Vulcan Orange, Watchung Red, Permanent Red, Brilliant Carmine 3B, Brilliant Carmine 6B, Du Pont Oil Red, pyrazolone red, lithol red, rhodamine B lake, lake red C, pigment red, rose bengal, aniline blue, ultramarine blue, chalco oil blue, methylene blue chloride, phthalocyanine blue, pigment blue, phthalocyanine green, and malachite green oxalate, and a variety of dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination.

The colorant may be optionally a surface-treated colorant or may be used in combination with a dispersant.

The amount of the colorant is, for instance, preferably from 1 mass % to 30 mass %, and more preferably from 3 mass % to 15 mass % relative to the amount of the whole toner particles.

Release Agent

The release agent is suitably a release agent that enables formation of the release agent domains in the toner particles. Examples of such a release gent include, but are not limited to, hydrocarbon waxes such as a paraffin wax and a Fischer-Tropsch wax; natural waxes such as a carnauba wax, a rice bran wax, and a candelilla wax; synthetic or mineral/petroleum waxes such as a montan wax; and ester waxes such as a fatty acid ester and a montanic acid ester.

Among these, release agents that are likely to form the release agent domains having a large aspect ratio are a paraffin wax and a Fischer-Tropsch wax.

Among the above examples of the release agent, release agents that are likely to form the release agent domains having a small aspect ratio are a carnauba wax and ester waxes.

The melting temperature of the release agent is preferably from 50° C. to 110° C., and more preferably from 60° C. to 100° C.

The melting temperature is determined from a DSC curve obtained by differential scanning calorimetry (DSC) in accordance with "Melting Peak temperature" described in determination of melting temperature in JIS K 7121-1987 "Testing Methods for Transition Temperatures of Plastics".

The amount of the release agent is, for example, preferably from 1 mass to 20 mass %, and more preferably from 5 mass to 15 mass %, relative to the amount of the whole toner particles.

Other Additives

Examples of other additives include known additives such as a magnetic material, a charge-controlling agent, and inorganic powder. These additives are contained in the toner particles as internal additives.

Characteristics of Toner Particles

The toner particles may have a monolayer structure or may have a core shell structure including a core (core particle) and a coating layer (shell layer) that covers the core.

The toner particles having a core shell structure, for instance, properly include a core containing the binder resin and optionally an additive, such as a colorant or a release agent, and a coating layer containing the binder resin.

The volume average particle size (D50v) of the toner particles is preferably from 2 μm to 10 μm, and more preferably from 4 μm to 8 μm.

The average particle size of the toner particles and the index of the particle size distribution thereof are measured with COULTER MULTISIZER II (manufactured by Beckman Coulter, Inc.) and an electrolyte that is ISOTON-II (manufactured by Beckman Coulter, Inc.).

In the measurement, from 0.5 mg to 50 mg of a test sample is added to 2 ml of an aqueous solution of a 5% surfactant (suitably sodium alkylbenzene sulfonate) as a dispersant. This product is added to from 100 ml to 150 ml of the electrolyte.

The electrolyte suspended with the sample is subjected to dispersion for 1 minute with an ultrasonic disperser and then subjected to the measurement of the particle size distribution of particles having a particle size ranging from 2 μm to 60 μm using COULTER MULTISIZER II with an aperture having an aperture diameter of 100 μm. The number of sampled particles is 50,000.

Cumulative distributions by volume and by number are drawn from the smaller diameter side in particle size ranges (channels) into which the measured particle size distribution is divided. The particle size for a cumulative percentage of 16% is defined as a volume particle size D16v and a number particle size D16p, while the particle size for a cumulative percentage of 50% is defined as a volume average particle size D50v and a number average particle size D50p. Furthermore, the particle size for a cumulative percentage of 84% is defined as a volume particle size D84v and a number particle size D84p.

From these particle sizes, the index of the volume particle size distribution (GSDv) is calculated as $(D84v/D16v)^{1/2}$, while the index of the number particle size distribution (GSDp) is calculated as $(D84p/D16p)^{1/2}$.

The average circularity of the toner particles is preferably from 0.94 to 1.00, and more preferably from 0.95 to 0.98.

The average circularity of the toner particles is determined from (circle-equivalent circumference)/(circumference) [circumference of circle having the same projection area as image of particle]/(circumference of projection image of particle)]. In particular, the average circularity of the toner particles is determined as follows.

The toner particles that are to be analyzed are collected by being sucked and allowed to flow in a flat stream. An image of the particles is taken as a still image by instant emission of stroboscopic light and then analyzed with a flow particle image analyzer (FPIA-3000 manufactured by SYSMEX CORPORATION). The number of samples used to determine the average circularity is 3500.

In the case where the toner contains an external additive, the toner (developer) to be analyzed is dispersed in water containing a surfactant and then subjected to an ultrasonic treatment to obtain toner particles having no external additive content.

The average of the maximum length of the release agent domains in the toner particles has an effect on the degree of the flow of the release agent out of the release agent domains and may be therefore appropriately determined on the basis of the types of a recording medium that is to be used in the image forming apparatus.

For example, in the case where a less rough and firm recording medium, such as thin coated paper (e.g., thickness from 0.05 mm to 0.10 mm), is used, the heat from the fixing belt is likely to be transmitted to the recording medium, and the release agent therefore tends to easily come out of the release agent domains in the toner particles in the fixing process. Hence, when such a less rough and firm recording medium, such as thin coated paper, is used, the maximum length of the release agent domains in the toner particles is suitably small (e.g., 100 nm or more and less than 300 nm, suitably from 130 nm to 270 nm).

Furthermore, in the case where a greatly rough recording medium, such as embossed paper (e.g., thickness from 0.13 mm to 0.30 mm), is used, the heat from the fixing belt is less likely to be transmitted to the recording medium, and the release agent is therefore less likely to come out of the release agent domains in the toner particles in the fixing process. In consideration of the fixing belt, it is desirable that the release agent also come out of a toner image formed on the recess of the rough surface profile. Hence, in the case where a greatly rough recording medium, such as embossed paper, is used, the maximum length of the release agent domains in the toner particles is suitably large (e.g., from 300 nm to 1500 nm, suitably from 330 nm to 1470 nm).

The maximum length of the release agent domains may be determined from the above-mentioned image analysis used in the determination of the aspect ratio of the release agent domains. The average of the maximum lengths refers to the value determined by measuring the maximum lengths of the release agent domains in 200 toner particles and then averaging them.

External Additives

Examples of external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surfaces of the inorganic particles as an external additive may be hydrophobized. The hydrophobization is performed by, for example, immersing the inorganic particles in a hydrophobizing agent. The hydrophobizing agent is not particularly limited; and examples thereof include silane coupling agents, silicone oils, titanate coupling agents, and aluminum coupling agents. These may be used alone or in combination The amount of the hydrophobizing agent is, for instance, generally from 1 part by mass to 10 parts by mass relative to 100 parts by mass of the inorganic particles.

Examples of the external additives also include resin particles [resin particles such as polystyrene particles, polymethyl methacrylate (PMMA) particles, and melamine resin particles] and cleaning aids (for instance, metal salts of higher fatty acids, such as zinc stearate, and particles of a high-molecular-weight fluorine material).

The amount of the external additive to be used is, for example, preferably from 0.01 mass % to 5 mass %, and more preferably from 0.01 mass % to 2.0 mass % relative to the amount of the toner particles.

Production of Toner

Production of the toner used in the exemplary embodiment will now be described.

The toner used in the exemplary embodiment can be produced by preparing toner particles and then externally adding an external additive to the toner particles.

The toner particles may be produced by any of a dry process (such as kneading pulverizing method) and a wet process (such as aggregation coalescence method, suspension polymerization method, or dissolution suspension method). Production of the toner particles is not particularly limited to these production processes, and any of known techniques can be employed.

The aspect ratio of the release agent domains in the toner particles and the distribution thereof are controlled to obtain a toner that satisfies the conditions 1 and 2 as described above; in order to control them, the toner particles are preferably produced by a wet process, and especially preferably by an aggregation coalescence method.

The control of the aspect ratio of the release agent domains in the toner particles and the distribution thereof by an aggregation coalescence method will now be described.

Aggregation Coalescence Method

An aggregation coalescence method that is an example of the method for producing the toner particles will now be described.

In the following description, a method for producing the toner particles containing a binder resin, a colorant, and a release agent will be explained; however, use of the colorant is optional. Additives other than the colorant and the release agent may be obviously used.

Specifically, the toner particles are suitably produced by an aggregation coalescence method through the following processes:

dispersion liquids are prepared (preparation of dispersion liquids);

a dispersion liquid of first resin particles in which first resin particles as the binder resin have been dispersed is mixed with a dispersion liquid of colorant particles in which the particles of the colorant (also referred to as "colorant particles") have been dispersed, and the individual particles are aggregated in the obtained mixed dispersion liquid to form first aggregated particles (formation of first aggregated particles);

a dispersion liquid of the first aggregated particles in which the first aggregated particles have been dispersed is produced, a mixed dispersion liquid in which second resin particles as the binder resin and the particles of the release agent (also referred to as "release agent particles") have been dispersed is prepared, and the mixed dispersion liquid is continuously added to the dispersion liquid of the first aggregated particles while the concentration of the release agent particles in the mixed dispersion liquid is gradually changed, so that the second resin particles and the release agent particles are aggregated on the surfaces of the first aggregated particles, thereby forming second aggregated particles (formation of second aggregated particles);

a dispersion liquid of the second aggregated particles in which the second aggregated particles have been dispersed is prepared, the dispersion liquid of the second aggregated particles is mixed with a dispersion liquid of third resin particles in which the third resin particles as the binder resin have been dispersed, and the third resin particles are aggregated such that the third resin particles adhere to the surfaces of the second aggregated particles, thereby forming third aggregated particles (formation of third aggregated particles); and a dispersion liquid of the third aggregated particles in which the third aggregated particles have been dispersed is heated to fuse and coalesce the third aggregated particles to form the toner particles (fusion and coalescence).

The production of the toner particles by an aggregation coalescence method is not limited to the above-mentioned processes.

The production of the toner particles may be, for example, as follows. The dispersion liquid of resin particles is mixed with the dispersion liquid of colorant particles, and the individual particles are aggregated in this mixed dispersion liquid. Then, in this process of aggregation, the dispersion liquid of release agent particles is added to the mixed dispersion liquid to further aggregate the individual particles while the rate of the addition is gradually increased or the concentration of the release agent particles is changed, thereby forming the aggregated particles.

Then, the aggregated particles are fused and coalesced to form the toner particles.

The concentration of the release agent is given a gradient in this manner in the formation of the aggregated particles, so that the aspect ratio of the release agent domains in the toner particles and the distribution thereof can be controlled.

At part of the aggregated particles having a high concentration of the release agent particles, the distance between the release agent particles is small, and the release agent is therefore likely to be aggregated in the fusion and coalescence; hence, the release agent domains having a large aspect ratio tend to be formed.

In contrast, at part of the aggregated particles having a low concentration of the release agent particles, the distance between the release agent particles is large, and the release agent is therefore hard to be aggregated in the fusion and coalescence; hence, the release agent domains having a small aspect ratio tend to be formed.

In the case where the concentration of the release agent is given a gradient in the manner described above, use of two different types of release agent makes it easier to control the aspect ratio of the release agent domains in the toner particles and the distribution thereof.

Specifically, for example, a release agent having a melting temperature with a small difference from the glass transition temperature or melting temperature of the resin particles (namely, binder resin) and another release agent having a melting temperature with a large difference therefrom are used. These release agents are used because the release agent having a melting temperature with a small difference from the glass transition temperature or melting temperature of the resin particles tends to easily form release agent domains having a small aspect ratio, and the release agent having a melting temperature with a large difference therefrom tends to readily form release agent domains having a large aspect ratio.

Alternatively, a release agent that is easy in the growth of a crystal and a release agent that is hard in the growth of a crystal may be used in combination. These release agents are used because the release agent having a high n-paraffin content, such as a paraffin wax or a Fischer-Tropsch wax, is easy in the growth of a crystal in one direction and therefore likely to easily form release agent domains having a large aspect ratio and the release agent, such as carnauba wax, is hard in the growth of a crystal and therefore likely to readily form release agent domains having a small aspect ratio.

Each of the processes will now be described in detail.

Preparation of Dispersion Liquids

The individual dispersion liquids used in the aggregation coalescence method are prepared.

Specifically, the following dispersion liquids are prepared: the dispersion liquid of first resin particles in which the first resin particles as a binder resin have been dispersed, the dispersion liquid of colorant particles in which the colorant particles have been dispersed, the dispersion liquid of second resin particles in which the second resin particles as a binder resin have been dispersed, the dispersion liquid of third resin particles in which the third resin particles as a binder resin have been dispersed, and the dispersion liquid of release agent particles in which the release agent particles have been dispersed.

In the preparation of the dispersion liquids, the first resin particles, the second resin particles, and the third resin particles are referred to as "resin particles" in the following description.

The dispersion liquid of the resin particles is, for example, prepared by dispersing the resin particles in a dispersion medium with a surfactant.

Examples of the dispersion medium used in the dispersion liquid of resin particles include aqueous media.

Examples of the aqueous media include water, such as distilled water and ion exchanged water, and alcohols. These aqueous media may be used alone or in combination.

Examples of the surfactant include anionic surfactants such as sulfuric acid ester salts, sulfonic acid salts, phosphoric acid esters, and soaps; cationic surfactants such as amine salts and quaternary ammonium salts; and nonionic surfactants such as polyethylene glycol, alkylphenol-ethylene oxide adducts and polyols. Among these surfactants, anionic surfactants and cationic surfactants may be used. Nonionic surfactants may be used in combination with anionic surfactants or cationic surfactants.

The surfactants may be used alone or in combination.

In the dispersion liquid of resin particles, the resin particles can be dispersed in the dispersion medium by any of known dispersion techniques; for example, general dispersers can be used, such as rotary shearing homogenizers or those having media, e.g., a ball mill, a sand mill, and a DYNO mill. Depending on the type of resin particles, the resin particles may be, for instance, dispersed in the dispersion liquid of resin particles by phase inversion emulsification.

In the phase inversion emulsification, a resin to be dispersed is dissolved in a hydrophobic organic solvent in which the resin can be dissolved, a base is added to an organic continuous phase (O phase) for neutralization, and then an aqueous medium (W phase) is added thereto to turn the phase to a discontinuous phase by the conversion of the resin (namely, phase inversion) from W/O to O/W, thereby dispersing the resin in the aqueous medium in the form of particles.

The volume average particle size of the resin particles to be dispersed in the dispersion liquid of resin particles is, for example, preferably from 0.01 μm to 1 μm, more preferably from 0.08 μm to 0.8 μm, and further preferably from 0.1 μm to 0.6 μm.

The volume average particle size of the resin particles is determined as follows. Particle size distribution is measured with a laser-diffraction particle size distribution analyzer (such as LA-700 manufactured by HORIBA, Ltd.), cumulative distribution by volume is drawn from the smaller diameter side in particle size ranges (channels) into which the measured particle size distribution is divided, and the particle size having a cumulative percentage of 50% relative to the whole particles is determined as the volume average particle size D50v. The volume average particles size of the particles in other dispersion liquids is similarly determined.

The amount of the resin particles contained in the dispersion liquid of resin particles is, for example, preferably from 5 mass % to 50 mass %, and more preferably from 10 mass % to 40 mass %.

The dispersion liquid of colorant particles and the dispersion liquid of release agent particles are, for instance, prepared in the same manner as the preparation of the dispersion liquid of resin particles.

Accordingly, the volume average particle size of the particles, the dispersion medium, the dispersion method, and the amount of the particles in the dispersion liquid of resin particles are the same as those of the colorant particles dispersed in the dispersion liquid of colorant particles and the release agent particles dispersed in the dispersion liquid of release agent particles.

Formation of First Aggregated Particles

The dispersion liquid of first resin particles is mixed with the dispersion liquid of colorant particles.

The first resin particles and the colorant particles are hetero-aggregated in the mixed dispersion liquid to form the first aggregated particles containing the first resin particles and the colorant particles.

Specifically, for example, an aggregating agent is added to the mixed dispersion liquid, and the pH of the mixed dispersion liquid is adjusted to be acidic (e.g., pH from 2 to 5). Then, a dispersion stabilizer is optionally added thereto, the resulting mixture is heated to a temperature corresponding to the glass transition temperature of the first resin particles (in particular, for example, −30° C. or more and −10° C. or less of the glass transition temperature of the first resin particles), and the particles dispersed in the mixed dispersion liquid are aggregated, thereby forming the first aggregated particles.

In the formation of the first aggregated particles, for instance, the aggregating agent may be added to the mixed dispersion liquid at room temperature (for instance, 25° C.) under stirring with a rotary shearing homogenizer, the pH of the mixed dispersion liquid may be adjusted to be acidic (e.g., pH from 2 to 5), a dispersion stabilizer may be optionally added thereto, and the resulting mixture may be heated.

Examples of the aggregating agent include surfactants having an opposite polarity to the surfactant used as a dispersant that is to be added to the mixed dispersion liquid, such as inorganic metal salts and di- or higher valent metal complexes. In the case where a metal complex is used as the aggregating agent, the surfactant can be used in a reduced amount, and charging properties can be improved.

An additive that forms a complex or a similar bond with the metal ions of the aggregating agent may be optionally used. Such an additive is suitably a chelating agent.

Examples of the inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent may be a water-soluble chelating agent. Examples of the chelating agent include oxycarboxylic acids such as tartaric acid, citric acid, and gluconic acid; iminodiacetic acid (IDA); nitrilotriacetic acid (NTA); and ethylenediaminetetraacetic acid (EDTA).

The amount of the chelating agent is, for example, preferably from 0.01 part by mass to 5.0 parts by mass, more preferably 0.1 part by mass or more and less than 3.0 parts by mass relative to 100 parts by mass of the first resin particles.

Formation of Second Aggregated Particles

A dispersion liquid of the first aggregated particles in which the first aggregated particles have been dispersed is prepared, and then a mixed dispersion liquid in which the second resin particles and the release agent particles have been dispersed is continuously added to the dispersion liquid of the first aggregated particles while the concentration of the release agent particles in the mixed dispersion liquid is gradually changed.

The second resin particles may be the same as or different from the first resin particles.

The second resin particles and the release agent particles are aggregated on the surfaces of the first aggregated particles in the dispersion liquid in which the first aggregated particles, the second resin particles, and the release agent particles have been dispersed. Specifically, for example, once the particle size of the first aggregated particles reaches the intended size in the formation of the first aggregated particles, the mixed dispersion liquid in which the second resin particles and the release agent particles have been dispersed is added to the dispersion liquid of the first aggregated particles while the concentration of the release agent particles is gradually changed. The resulting dispersion liquid is heated at a temperature less than or equal to the glass transition temperature of the second resin particles.

Through this process, aggregated particles in which the second resin particles and the release agent particles are adhering to the surfaces of the first aggregated particles are formed.

In other words, the second aggregated particles in which aggregates of the second resin particles and release agent particles are adhering to the surfaces of the first aggregated particles are formed. Since the mixed dispersion liquid in which the second resin particles and the release agent particles have been dispersed is continuously added to the dispersion liquid of the first aggregated particles while the concentration of the release agent particles in the mixed dispersion liquid is gradually changed (for example, increased), the aggregates of the second resin particles and release agent particles adhere to the surfaces of the first aggregated particles such that the concentration of the release agent particles (abundance) gradually changes (for instance, increases) outward in the diameter direction.

The mixed dispersion liquid may be added by a power-feed addition method.

The power-feed addition method enables addition of the mixed dispersion liquid to the dispersion liquid of the first aggregated particles while the concentration of the release agent particles in the mixed dispersion liquid is gradually changed.

The addition of the mixed dispersion liquid by the power-feed addition method will now be described with reference to the drawing.

A method for adding the mixed dispersion liquid to the dispersion liquid of the first aggregated particles while the concentration of the release agent particles in the mixed dispersion liquid is gradually increased will now be described.

Figure 3:
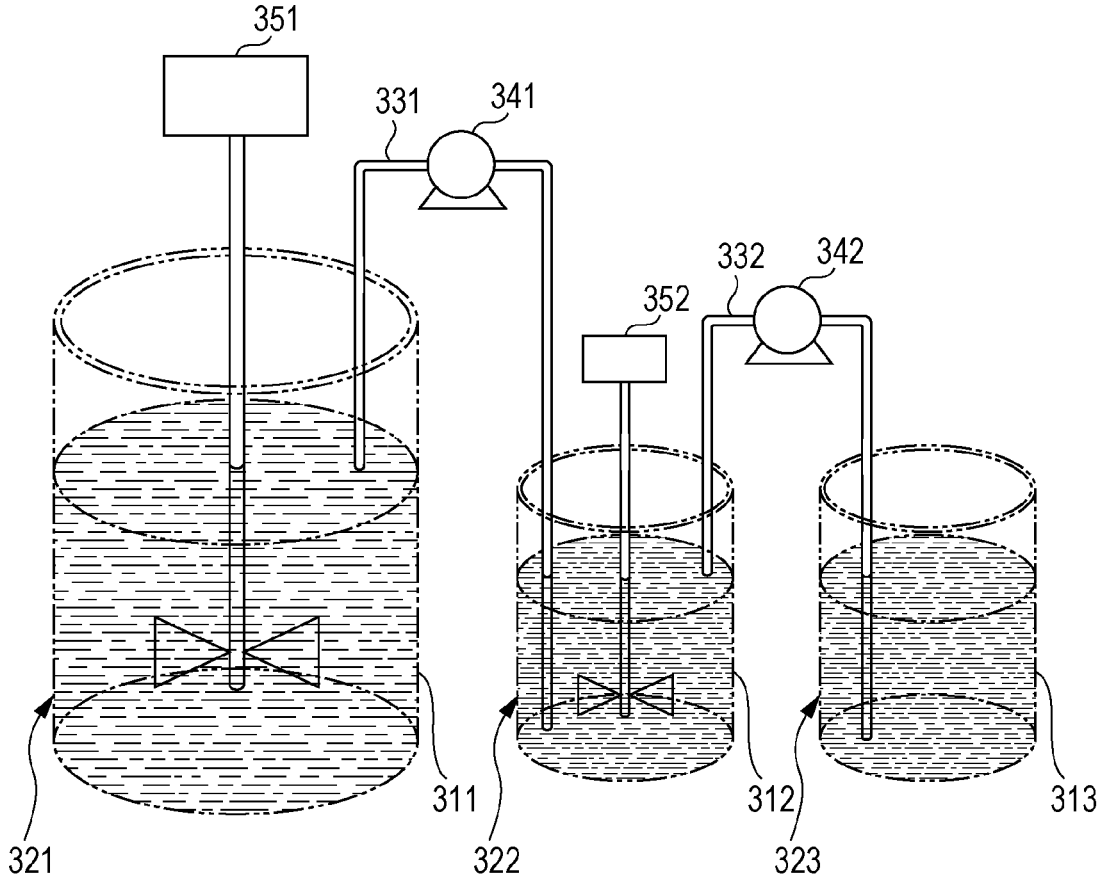
FIG. 3 schematically illustrates a power-feed addition method.

FIG. 3 illustrates an apparatus used in the power-feed addition method. In FIG. 3, the number 311 denotes the dispersion liquid of the first aggregated particles, the number 312 denotes the dispersion liquid of second resin particles, and the number 313 denotes the dispersion liquid of release agent particles.

The apparatus illustrated in FIG. 3 includes a first container 321 that contains the dispersion liquid of the first aggregated particles in which the first aggregated particles have been dispersed, a second container 322 that contains the dispersion liquid of second resin particles in which the second resin particles have been dispersed, and a third container 323 that contains the dispersion liquid of release agent particles in which the release agent particles have been dispersed.

The first container 321 is in connection with the second container 322 via a first liquid supply tube 331. A first liquid supply pump 341 is disposed in the middle of the first liquid supply tube 331. The first liquid supply pump 341 is driven to supply the dispersion liquid in the second container 322 to the dispersion liquid in the first container 321 via the first liquid supply tube 331.

The first container 321 has a first stirrer 351. The first stirrer 351 is driven to stirrer and mix the dispersion liquids in the first container 321 when the dispersion liquid in the second container 322 is supplied to the dispersion liquid in the first container 321.

The second container 322 is in connection with the third container 323 via a second liquid supply tube 332. A second liquid supply pump 342 is disposed in the middle of the second liquid supply tube 332. The second liquid supply pump 342 is driven to supply the dispersion liquid in the third container 323 to the dispersion liquid in the second container 322 via the second liquid supply tube 332.

The second container 322 has a second stirrer 352. The second stirrer 352 is driven to stirrer and mix the dispersion liquids in the second container 322 when the dispersion liquid in the third container 323 is supplied to the dispersion liquid in the second container 322.

In the apparatus illustrated in FIG. 3, the first aggregated particles are formed in the first container 321 to produce the dispersion liquid of the first aggregated particles, and the first container 321 holds the dispersion liquid of the first aggregated particles. The first aggregated particles may be formed in another container to produce the dispersion liquid of the first aggregated particles, and the dispersion liquid of the first aggregated particles may be held by the first container 321.

In this state, the first liquid supply pump 341 and the second liquid supply pump 342 are driven. The driving of these pumps enables the dispersion liquid of second resin particles in the second container 322 to be supplied to the dispersion liquid of the first aggregated particles in the first container 321. The first stirrer 351 is driven to stir and mix the dispersion liquids in the first container 321.

The dispersion liquid of release agent particles in the third container 323 is supplied to the dispersion liquid of second resin particles in the second container 322. The second stirrer 352 is driven to stir and mix the dispersion liquids in the second container 322.

In this process, the dispersion liquid of release agent is continuously supplied to the dispersion liquid of second resin particles in the second container 322, and the concentration of the release agent particles therefore gradually increases. Thus, the mixed dispersion liquid in which the second resin particles and the release agent particles have been dispersed is in the second container 322 and supplied to the dispersion liquid of the first aggregated particles in the first container 321. The mixed dispersion liquid is continuously supplied with an increase in the concentration of the dispersion liquid of release agent particles in the mixed dispersion liquid.

In this manner, the power-feed addition method enables the mixed dispersion liquid in which the second resin particles and the release agent particles have been dispersed to be added to the dispersion liquid of the first aggregated particles while the concentration of the release agent particles is gradually increased.

In the power-feed addition method, the onset time of supplying the dispersion liquids in the second container 322 and the third container 323 and the supply rates can be adjusted to control the concentration distribution of the release agent particles to be outward in the diameter direction of the aggregated particles. Furthermore, in the power-feed addition method, the supply rates can be also adjusted during the supply of the dispersion liquids in the second container 322 and the third container 323 to control the concentration distribution of the release agent particles to be outward in the diameter direction of the aggregated particles.

The concentration distribution of the release agent in the toner particles is controlled in this manner, so that the release agent near the surface layer of the toner is readily melted when heating is performed in the fusion and coalescence that will be described below; thus, the high-concentration part is likely to be fused and easily form the release agent domains having a large aspect ratio. Moreover, giving a gradient to the concentration distribution of the release agent in the toner particles enables the distribution of the aspect ratio of the release agent domains to be controlled. In addition, using two or more types of release agent in the power-feed addition method enables the distribution of the aspect ratio of the release agent domains in the toner particles to be suitably controlled.

The power-feed addition method is not limited to the above-mentioned process.

A variety of processes may be employed, such as a process involving separately preparing a container that contains the dispersion liquid of second resin particles and another container that contains the mixed dispersion liquid in which the second resin particles and the release agent particles have been dispersed and supplying the dispersion liquids in these containers to the first container 321 with the supply rates being changed and a process involving separately preparing a container that contains the dispersion liquid of release agent particles and another container that contains the mixed dispersion liquid in which the second resin particles and the release agent particles have been dispersed and supplying the dispersion liquids in these containers to the first container 321 with the supply rates being changed.

The second container 322 may contain the dispersion liquid of release agent particles in which the release agent particles have been dispersed, the third container 323 may contain the dispersion liquid of second resin particles in which the second resin particles have been dispersed, and the mixed dispersion liquid may be added to the dispersion liquid of the first aggregated particles while the concentration of the release agent particles in the mixed dispersion liquid is gradually decreased.

Through this process, the second aggregated particles, in which the second resin particles and the release agent particles are aggregated on the surfaces of the first aggregated particles such that the second resin particles and the release agent particles are adhering to the surfaces of the first aggregated particles, are produced.

Formation of Third Aggregated Particles

The dispersion liquid of the second aggregated particles in which the second aggregated particles have been dispersed is prepared, and then the dispersion liquid of the second aggregated particles is mixed with the dispersion liquid of third resin particles in which the third resin particles as a binder resin have been dispersed.

The third resin particles may be the same as or different from the first or second resin particles.

The third resin particles are aggregated on the surfaces of the second aggregated particles in the dispersion liquid in which the second aggregated particles and the third resin particles have been dispersed.

Specifically, for example, when the particle size of the second aggregated particles has reached the intended particle size in the formation of the second aggregated particles, the dispersion liquid of third resin particles is added to the dispersion liquid of the second aggregated particles. This mixed dispersion liquid is heated at a temperature less than or equal to the glass transition temperature of the third resin particles. Then, the pH of the mixed dispersion liquid is adjusted to be, for example, approximately in the range of 6.5 to 8.5 to terminate the aggregation.

Fusion and Coalescence

The dispersion liquid of the third aggregated particles in which the third aggregated particles have been dispersed is, for example, heated to the glass transition temperatures or more of the first, second, and third resin particles (such as from 10° C. to 30° C. higher than the glass transition temperatures of the first, second, and third resin particles) to fuse and coalesce the third aggregated particles, thereby forming the toner particles.

Through the above-mentioned processes, the toner particles are produced.

In particular, the toner particles (toner) produced through the above-mentioned processes are the toner particles in which the number frequency distribution of the aspect ratio of the release agent domains has been controlled and which has the mode and skewness in the above-mentioned ranges.

After the fusion and coalescence, the toner particles formed in the solution are washed, subjected to solid-liquid separation, and dried by known techniques to yield dried toner particles.

The washing may be sufficiently carried out by displacement washing with ion exchanged water in terms of charging properties. The solid-liquid separation is not particularly limited but may be suction filtration or pressure filtration in terms of productivity. The drying is not particularly limited but may be freeze drying, flush drying, fluidized drying, or vibratory fluidized drying in terms of productivity.

An external additive is, for instance, added to the toner particles produced in the above-mentioned manner and being in a dried state, and the resulting toner particles are mixed to produce the toner according to the exemplary embodiments.

The mixing may be performed, for example, with a V-blender, a HENSCHEL MIXER, or a LOEDIGE MIXER.

The coarse particles of the toner may be optionally removed with a vibrating sieve, an air sieve, or another device.

Carrier

The carrier is not particularly limited, and any of known carriers can be used. Examples of the carrier include coated carriers in which the surface of a core formed of magnetic powder has been coated with a coating resin, magnetic powder dispersed carriers in which magnetic powder has been dispersed in or blended with a matrix resin, and resin impregnated carriers in which porous magnetic powder has been impregnated with resin.

In the magnetic powder dispersed carriers and the resin impregnated carriers, the constituent particles may have a surface coated with a coating resin.

Examples of the magnetic powder include magnetic metals, such as iron, nickel, and cobalt, and magnetic oxides such as ferrite and magnetite.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins containing an organosiloxane bond or a modified product thereof, fluororesins, polyester, polycarbonate, phenol resins, and epoxy resins.

The coating resin and the matrix resin may contain other additives such as conductive particles.

Examples of the conductive particles include particles of metals such as gold, silver, and copper; carbon black particles; titanium oxide particles; zinc oxide particles; tin oxide particles; barium sulfate particles; aluminum borate particles; and potassium titanate particles.

An example of the preparation of the coated carrier involves coating with a coating layer forming solution in which the coating resin and optionally a variety of additives have been dissolved in a proper solvent. The solvent is not particularly limited and may be determined in view of, for instance, the type of coating resin to be used and coating suitability.

Specific examples of the coating method include a dipping method of dipping the core into the coating layer forming solution, a spray method of spraying the coating layer forming solution onto the surface of the core, a fluid-bed method of spraying the coating layer forming solution to the core that is in a state of being floated by the flowing air, and a kneader coating method of mixing the core of the carrier with the coating layer forming solution in the kneader coater and removing a solvent.

The mixing ratio (mass ratio) of the toner to the carrier in the two-component developer (toner:carrier) is preferably from 1:100 to 30:100, and more preferably from 3:100 to 20:100.

Examples

The present disclosure will now be further specifically described in detail with reference to Examples and Comparative Examples but is not limited thereto at all.

Developer (1)

Preparation of Dispersion Liquid of Resin Particles

Preparation of Dispersion Liquid (1) of Resin Particles

Terephthalic acid: 30 parts by mole

Fumaric acid: 70 parts by mole

Ethylene oxide adduct of bisphenol A: 5 parts by mole

Propylene oxide adduct of bisphenol A: 95 parts by mole

These materials are put into a 5-liter flask equipped with a stirrer, a nitrogen inlet tube, a temperature sensor, and a fractionating column. The temperature is increased up to 210° C. over 1 hour, and 1 part of titanium tetraethoxide relative to 100 parts of the materials is added thereto. The temperature is increased up to 230° C. over 0.5 hours while generated water is removed by distillation, a dehydration condensation reaction is continued at this temperature for 1 hour, and then the reactant is cooled. Through this process, a polyester resin (1) having a weight average molecular weight of 18,500, an acid value of 14 mgKOH/g, and a glass transition temperature of 59° C. has been synthesized.

Into a container equipped with a temperature controller and a nitrogen-purge unit, 40 parts of ethyl acetate and 25 parts of 2-butanol are put to obtain a mixed solvent, and 100 parts of the polyester resin (1) is gradually added thereto and dissolved. Then, 10 mass % of aqueous ammonium solution (corresponding to three times the amount to the acid value of the resin on a molar ratio basis) is added thereto, and the resulting solution is stirred for 30 minutes.

The inside of the container is purged with dry nitrogen, and 400 parts of ion exchanged water is added to the liquid mixture at a rate of 2 parts/min under stirring for emulsification while the temperature is maintained at 40° C. After the addition of the ion exchanged water, the temperature of the emulsified liquid is decreased to room temperature (from 20° C. to 25° C.) and subjected to bubbling with dry nitrogen for 48 hours under stirring to reduce the amounts of the ethyl acetate and 2-butanol to 1,000 ppm or less, thereby obtaining the dispersion liquid of resin particles in which polyester resin particles having a volume average particle size of 200 nm have been dispersed. Ion exchanged water is added to the dispersion liquid of resin particles to adjust the solid content to be 20 mass %, thereby producing dispersion liquid (1) of resin particles.

Preparation of Dispersion Liquid of Colorant Particles

Preparation of Dispersion Liquid (1) of Colorant Particles

Cyan pigment C.I. Pigment Blue 15:3: 70 parts (copper phthalocyanine, manufactured by DIC Corporation, tradename "FASTOGEN BLUE LA5380")

Anionic surfactant (NEOGEN RK manufactured by DKS Co. Ltd.): 5 parts

Ion exchanged water: 200 parts

These materials are mixed with each other and dispersed for 10 minutes with a homogenizer (ULTRA-TURRAX T50 manufactured by IKA Works, Inc.). Ion exchanged water is added thereto to adjust the solid content in the dispersion liquid to be 20 mass %, thereby producing a dispersion liquid (1) of colorant particles in which colorant particles having a volume average particle size of 190 nm have been dispersed.

Preparation of Dispersion Liquid of Release Agent Particles

Preparation of Dispersion Liquid (1) of Release Agent Particles

Fischer-Tropsch wax: 100 parts (FNP0080 manufactured by NIPPON SEIRO CO., LTD., melting temperature: 81° C.)

Anionic surfactant (NEOGEN RK manufactured by DKS Co. Ltd.): 1 part

Ion exchanged water: 350 parts

These materials are mixed with each other and heated to 100° C. The mixture is dispersed with a homogenizer (ULTRA-TURRAX T50 manufactured by IKA Works, Inc.) and then further dispersed with a Manton-Gaulin high-pressure homogenizer (manufactured by Gaulin Corporation), thereby producing a dispersion liquid (1) of release agent particles in which release agent particles having a volume average particle size of 200 nm have been dispersed (solid content of 20 mass).

Preparation of Dispersion Liquid (2) of Release Agent Particles

Carnauba wax: 100 parts (RC-160 manufactured by TOA KASEI CO., LTD., melting temperature: 81° C.)

Anionic surfactant (NEOGEN RK manufactured by DKS Co. Ltd.): 1 part

Ion exchanged water: 350 parts

These materials are mixed with each other and heated to 100° C. The mixture is dispersed with a homogenizer (ULTRA-TURRAX T50 manufactured by IKA Works, Inc.) and then further dispersed with a Manton-Gaulin high-pressure homogenizer (manufactured by Gaulin Corporation), thereby producing a dispersion liquid (2) of release agent particles in which release agent particles having a volume average particle size of 200 nm have been dispersed (solid content of 20 mass %).

Preparation of Toner Particles

Figure 4:
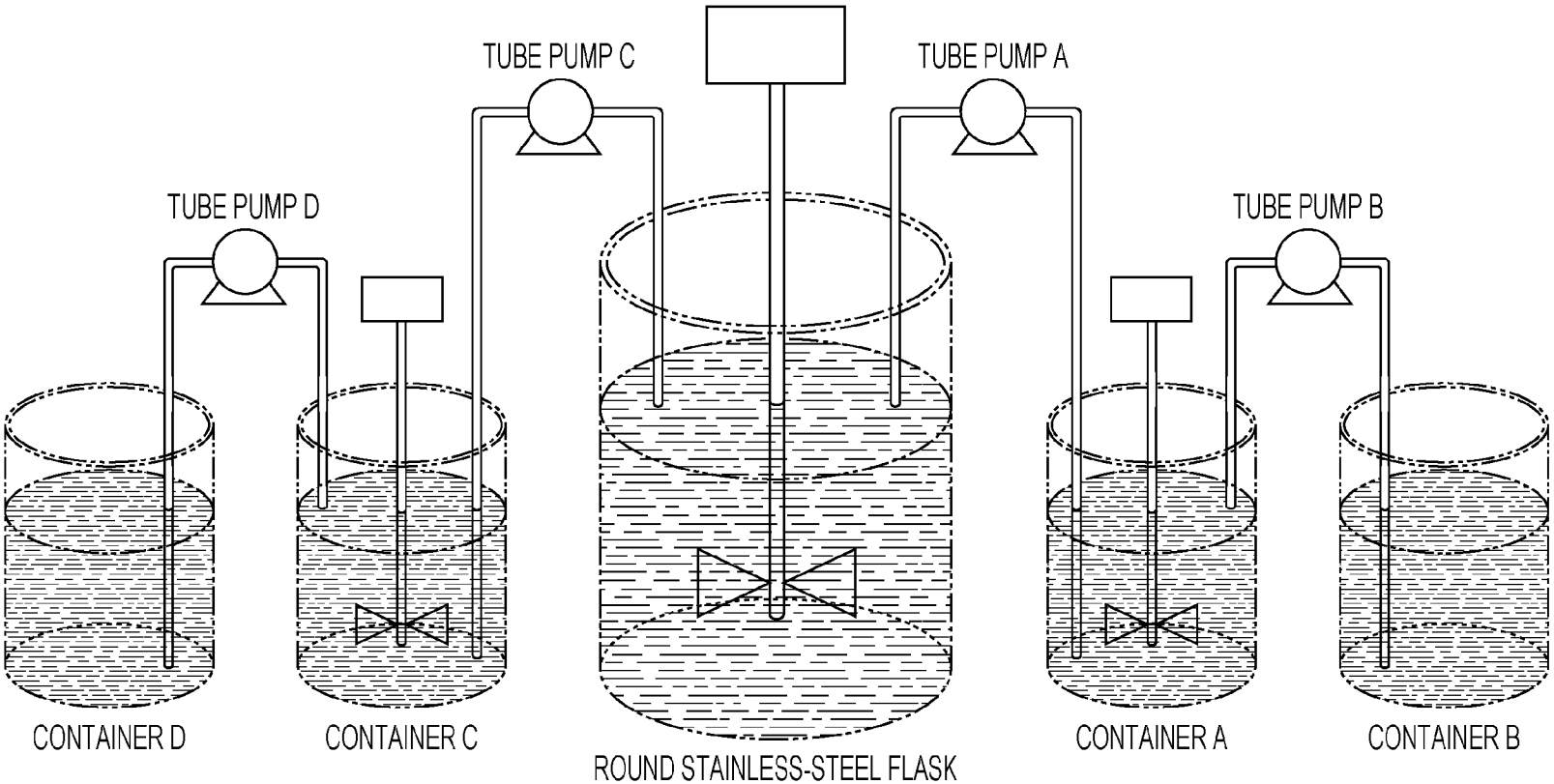
FIG. 4 schematically illustrates an apparatus used in Examples for the power-feed addition method.

An apparatus illustrated in FIG. 4 is prepared on the basis of the apparatus illustrated in FIG. 3 for a power-feed addition method.

In the apparatus illustrated in FIG. 4, members on the right side of the drawing, including a round stainless-steel flask, carries out a first power-feed addition process; and members on the left side of the drawing, including the round stainless-steel flask, carries out a second power-feed addition process.

In the members that carries out the first power-feed addition process, the round stainless-steel flask is in connection with a container A via a tube pump A, and the tube pump A is driven to supply a liquid in the container A to the flask. In addition, the container A is in connection with a container B via a tube pump B, and the tube pump B is driven to supply a liquid in the container B to the container A.

In the members that carries out the second power-feed addition process, the round stainless-steel flask is in connection with a container C via a tube pump C, and the tube pump C is driven to supply a liquid in the container C to the flask. In addition, the container C is in connection with a container D via a tube pump D, and the tube pump D is driven to supply a liquid in the container D to the container C.

The liquid in each of the container A, the container C, and the round stainless-steel flask is stirred with a stirrer.

The following process is carried out with the apparatus illustrated in FIG. 4.

Dispersion liquid (1) of resin particles: 53.1 parts

Dispersion liquid (1) of colorant particles: 25 parts

Anionic surfactant (TAYCAPOWER): 2 parts

These materials are put into the round stainless-steel flask, 0.1 N of nitric acid is added thereto to adjust pH to be 3.5, and then 30 parts of an aqueous nitric acid solution having a polyaluminum chloride concentration of 10 mass is added thereto. The content of the flask is dispersed at 30° C. with a homogenizer (ULTRA-TURRAX T50 manufactured by IKA Works, Inc.), and then the particle size of first aggregated particles is developed while the temperature is increased in a heating oil bath at a rate of 1° C./30 minutes.

Meanwhile, 20 parts of the dispersion liquid (2) of release agent particles is put in the container A of a polyester bottle, and 207.9 parts of the dispersion liquid (1) of resin particles is put into the container B of a polyester bottle. The rates at which the tube pumps A and B supply the liquids are set to be 3 parts/min and 6 parts/min, respectively. The temperature inside the round stainless-steel flask is increased at 1° C./min during the formation of the first aggregated particles, and the increase in the temperature is stopped once the particle size of the first aggregated particles reaches 2.9 μm. Then, the tube pumps A and B are simultaneously driven to individually supply the liquids.

The liquids in the flask are maintained under stirring for 30 minutes from the time that the supply of the liquids to the flask is completed, thereby forming second aggregated particles.

Then, 30 parts of the dispersion liquid (1) of release agent particles is put into the container C of a polyester bottle, and 164.0 parts of the dispersion liquid (1) of resin particles is put into the container D of a polyester bottle. The rates at which the tube pumps C and D supply the liquids are set to be 9 parts/min and 6 parts/min, respectively, and the tube pumps C and D are simultaneously driven to supply the individual liquids.

After the supply of the liquids to the flask is completed, the temperature is increased by 1° C., and the liquids in the flask are maintained under stirring for 30 minutes, thereby forming third aggregated particles.

Then, 0.1 N of an aqueous solution of sodium hydroxide is added thereto to adjust pH to be 8.5. The temperature is subsequently increased up to 85° C. while stirring is continued, and the resulting product is held for 5 hours. The resulting product is cooled up to 20° C. at a rate of 20° C./min, filtrated, sufficiently washed with ion exchanged water, and dried to yield toner particles (1) having a volume average particle size of 6.0 μm.

Preparation of Toner (1)

With 100 parts of the toner particles (1), 0.7 parts of silica particles treated with dimethyl silicone oil (RY200 manufactured by NIPPON AEROSIL CO., LTD.) is mixed using a HENSCHEL MIXER to produce a toner (1).

Preparation of Developer (1)

Ferrite particles (average particle size: 50 μm): 100 parts

Toluene: 14 parts

Styrene/methyl methacrylate copolymer (copolymerization ratio: 15/85): 3 parts

Carbon black: 0.2 parts

These materials other than the ferrite particles are dispersed with a sand mill to prepare a dispersion liquid, and this dispersion liquid and the ferrite particles are put into a vacuum degassing kneader and dried by reducing pressure under stirring, thereby yielding a carrier.

Then, 100 parts of the carrier is mixed with 8 parts of the toner (1), thereby producing a developer (1).

Developer (2)

In the production of the toner particles (1), 15 parts of the dispersion liquid (2) of release agent particles is put into the container A of the polyester bottle, and 40 parts of the dispersion liquid (1) of release agent particles is put into the container C of the polyester bottle, the rate of supplying the liquid by the tube pump C is changed to 10 parts/min, and the rate of supplying the liquid by the tube pump D is changed to 5 parts/min. Except for these changes, toner particles (2) having a volume average particle size of 6.2 μm are produced as in the production of the toner particles (1).

The toner particles (2) are used to produce a toner (2) and a developer (2) as in the production of the toner (1) and developer (1).

Developer (3)

In the production of the toner particles (1), 30 parts of the dispersion liquid (2) of release agent particles is put into the container A of the polyester bottle, 10 parts of the dispersion liquid (1) of release agent particles is put into the container C of the polyester bottle, and the rate of supplying the liquid by the tube pump C is changed to 7 parts/min. Except for these changes, toner particles (3) having a volume average particle size of 6.1 μm are produced as in the production of the toner particles (1).

The toner particles (3) are used to produce a toner (3) and a developer (3) as in the production of the toner (1) and developer (1).

Developer (4)

In the production of the toner particles (1), the dispersion liquid (1) of resin particles is changed to the following dispersion liquid (2) of resin particles. Except for this change, toner particles (4) having a volume average particle size of 6.3 μm are produced as in the production of the toner particles (1).

The toner particles (4) are used to produce a toner (4) and a developer (4) as in the production of the toner (1) and developer (1).

Preparation of Dispersion Liquid (2) of Resin Particles

Styrene (manufactured by FUJIFILM Wako Pure Chemical Corporation): 330 parts by mass n-butyl acrylate (manufactured by FUJIFILM Wako Pure Chemical Corporation): 60 parts by mass Dodecanthiol (manufactured by FUJIFILM Wako Pure Chemical Corporation): 3.1 parts by mass These materials are mixed with each other and dissolved, and this solution is emulsified and dispersed in a solution in which 6 parts by mass of a nonionic surfactant (NONIPOL 400 manufactured by Sanyo Chemical Industries, Ltd.) and 10 parts by mass of an anionic surfactant (NEOGEN SC manufactured by DKS Co. Ltd.) have been dissolved in 550 parts by mass of ion exchanged water in a flask. Then, a solution of 4 parts by mass of ammonium persulfate in 50 parts by mass of ion exchanged water is added to the solution under slow mixing over 10 minutes. The inside of the flask is purged with nitrogen, the flask is subsequently heated in an oil bath under stirring of the inside of the flask until the temperature of the content in the flask reaches 70° C., and then emulsion polymerization is continued for 5 hours. Through this process, a dispersion liquid (2) of resin particles in which styrene-acrylic resin particles having a volume average particle size D50v of 104 nm, a glass transition temperature Tg of 52° C., and a weight average molecular weight of 34,000 have been dispersed is produced.

Developer (5)

In the production of the toner particles (2), the dispersion liquid (1) of resin particles is changed to the dispersion liquid (2) of resin particles. Except for this change, toner particles (5) having a volume average particle size of 6.4 μm are produced as in the production of the toner particles (2).

The toner particles (5) are used to produce a toner (5) and a developer (5) as in the production of the toner (1) and developer (1).

Developer (6)

In the production of the toner particles (1), 10 parts of the dispersion liquid (1) of release agent particles is put into the container A of the polyester bottle, 60 parts of the dispersion liquid (1) of release agent particles is put into the container C of the polyester bottle, the rate of supplying the liquid by the tube pump C is changed to 10 parts/min, and the rate of supplying the liquid by the tube pump D is changed to 5 parts/min. Except for these changes, toner particles (6) having a volume average particle size of 6.4 μm are produced as in the production of the toner particles (1).

The toner particles (6) are used to produce a toner (6) and a developer (6) as in the production of the toner (1) and developer (1).

Developer (7)

Dispersion liquid (1) of resin particles: 402.5 parts

Dispersion liquid (1) of colorant particles: 22.5 parts

Dispersion liquid (1) of release agent particles: 25 parts

These materials are put into the round stainless-steel flask, 0.1 N of nitric acid is added thereto to adjust pH to be 3.5, and then 30 parts of an aqueous nitric acid solution having a polyaluminum chloride concentration of 10 mass is added thereto. The content of the flask is dispersed at 30° C. with a homogenizer (ULTRA-TURRAX T50 manufactured by IKA Works, Inc.), subsequently heated up to 45° C. in a heating oil bath, and then held for 30 minutes. Then, 25 parts of the dispersion liquid (1) of release agent particles are slowly added thereto, and the resulting product is held for 30 minutes. Then, 100 parts of the dispersion liquid (1) of resin particles is slowly added thereto, and the resulting product is held for 1 hour. Then, 0.1 N of an aqueous sodium hydroxide solution is added thereto to adjust pH to be 8.5. The temperature is increased up to 85° C. while stirring is continued, and the resulting product is held for 5 hours. The resulting product is cooled up to 20° C. at a rate of 20° C./min, filtrated, sufficiently washed with ion exchanged water, and dried to yield toner particles (7) having a volume average particle size of 6.2 μm.

The toner particles (7) are used to produce a toner (7) and a developer (7) as in the production of the toner (1) and the developer (1).

Developer (8)

Dispersion liquid (1) of resin particles: 402.5 parts

Dispersion liquid (1) of colorant particles: 22.5 parts

Dispersion liquid (1) of release agent particles: 25 parts

Dispersion liquid (2) of release agent particles: 25 parts

Anionic surfactant (TAYCAPOWER): 2 parts

These materials are put into the round stainless-steel flask, 0.1 N of nitric acid is added thereto to adjust pH to be 3.5, and then 30 parts of an aqueous nitric acid solution having a polyaluminum chloride concentration of 10 mass is added thereto. The content of the flask is dispersed at 30° C. with a homogenizer (ULTRA-TURRAX T50 manufactured by IKA Works, Inc.), subsequently heated up to 45° C. in a heating oil bath, and then held for 30 minutes. Then, 100 parts of the dispersion liquid (1) of resin particles is slowly added thereto, and the resulting product is held for 1 hour. Then, 0.1 N of an aqueous sodium hydroxide solution is added thereto to adjust pH to be 8.5. The temperature is increased up to 85° C. while stirring is continued, and the resulting product is held for 5 hours. The resulting product is cooled up to 20° C. at a rate of 20° C./min, filtrated, sufficiently washed with ion exchanged water, and dried to yield toner particles (8) having a volume average particle size of 6.2 μm.

The toner particles (8) are used to produce a toner (8) and a developer (8) as in the production of the toner (1) and the developer (1).

Developer (9)

In the production of the toner particles (8), the amount of the dispersion liquid (2) of release agent particles is changed to 50 parts, and the amount of the dispersion liquid (1) of release agent particles is changed to 0 part. Except for these changes, toner particles (9) having a volume average particle size of 6.2 μm are produced as in the production of the toner particles (8).

The toner particles (9) are used to produce a toner (9) and a developer (9) as in the production of the toner (1) and developer (1).

Developer (C1)

In the production of the toner particles (8), the amount of the dispersion liquid (2) of release agent particles is changed to 0 part, and the dispersion liquid (1) of resin particles is changed to the following dispersion liquid (3) of resin particles. Except for these changes, toner particles (C1) having a volume average particle size of 6.1 μm are produced as in the production of the toner particles (8).

The toner particles (C1) are used to produce a toner (C1) and a developer (C1) as in the production of the toner (1) and developer (1).

Preparation of Dispersion Liquid (3) of Resin Particles

Terephthalic acid: 15 parts by mole

Fumaric acid: 70 parts by mole

Ethylene oxide adduct of bisphenol A: 5 parts by mole

Propylene oxide adduct of bisphenol A: 95 parts by mole

These materials are put into a 5-liter flask equipped with a stirrer, a nitrogen inlet tube, a temperature sensor, and a fractionating column. The temperature is increased up to 210° C. over 1 hour, and 1 part of titanium tetraethoxide relative to 100 parts of the materials is added thereto. The temperature is increased up to 230° C. over 0.5 hours while generated water is removed by distillation, a dehydration condensation reaction is continued at this temperature for 0.5 hours, and then the reactant is cooled. Through this process, a polyester resin (2) having a weight average molecular weight of 16,000, an acid value of 13 mgKOH/g, and a glass transition temperature of 55° C. has been synthesized.

Into a container equipped with a temperature controller and a nitrogen-purge unit, 40 parts of ethyl acetate and 25 parts of 2-butanol are put to obtain a mixed solvent, and 100 parts of the polyester resin (2) is gradually added thereto and dissolved. Then, 10 mass % of aqueous ammonium solution (corresponding to three times the amount to the acid value of the resin on a molar ratio basis) is added thereto, and the resulting solution is stirred for 30 minutes.

The inside of the container is purged with dry nitrogen, and 400 parts of ion exchanged water is added to the liquid mixture at a rate of 2 parts/min under stirring for emulsification while the temperature is maintained at 40° C. After the addition of the ion exchanged water, the temperature of the emulsified liquid is decreased to room temperature (from 20° C. to 25° C.) and subjected to bubbling with dry nitrogen for 48 hours under stirring to reduce the amounts of the ethyl acetate and 2-butanol to 1,000 ppm or less, thereby obtaining the dispersion liquid of resin particles in which polyester resin particles having a volume average particle size of 200 nm have been dispersed. Ion exchanged water is added to the dispersion liquid of resin particles to adjust the solid content to be 20 mass %, thereby producing dispersion liquid (3) of resin particles.

Developer (C2)

In the production of the toner particles (8), the amount of the dispersion liquid (1) of release agent particles is changed to 0 part, and the dispersion liquid (1) of resin particles is changed to the following dispersion liquid (4) of resin particles. Except for these changes, toner particles (C2) having a volume average particle size of 6.0 μm are produced as in the production of the toner particles (8).

The toner particles (C2) are used to produce a toner (C2) and a developer (C2) as in the production of the toner (1) and developer (1).

Preparation of Dispersion Liquid (4) of Resin Particles

Styrene (manufactured by FUJIFILM Wako Pure Chemical Corporation): 330 parts by mass n-butyl acrylate (manufactured by FUJIFILM Wako Pure Chemical Corporation): 60 parts by mass Dodecanthiol (manufactured by FUJIFILM Wako Pure Chemical Corporation): 3.1 parts by mass These materials are mixed with each other and dissolved, and this solution is emulsified and dispersed in a solution in which 6 parts by mass of a nonionic surfactant (NONIPOL 400 manufactured by Sanyo Chemical Industries, Ltd.) and 10 parts by mass of an anionic surfactant (NEOGEN SC manufactured by DKS Co. Ltd.) have been dissolved in 550 parts by mass of ion exchanged water in a flask. Then, a solution of 4 parts by mass of ammonium persulfate in 50 parts by mass of ion exchanged water is added to the solution under slow mixing over 10 minutes. The inside of the flask is purged with nitrogen, the flask is subsequently heated in an oil bath under stirring of the inside of the flask until the temperature of the content in the flask reaches 70° C., and then emulsion polymerization is continued for 10 hours. Through this process, a dispersion liquid (4) of resin particles in which styrene-acrylic resin particles having a volume average particle size D50v of 110 nm, a glass transition temperature Tg of 66° C., and a weight average molecular weight of 37,000 have been dispersed is produced.

Measurements

The mode and skewness in the number frequency distribution of the aspect ratio of the release agent domains in the toners used in the developers produced in Examples are determined in the manner described above.

The maximum length of the release agent domains is also determined in the manner described above.

Table 1 shows results thereof.

Evaluation

The produced developers are used to perform the following image formation and evaluation. Table 1 shows results thereof.

Examples 1 to 9 and Comparative Examples 1 and 2: Image Formation and Evaluation The following process and image formation are carried out at a temperature of 23° C. and a humidity of 55%.

DocuCentreIV C5575 is prepared and modified into an apparatus having a fixing device with the structure illustrated in FIG. 2. This modified apparatus is used as an image forming apparatus for forming an evaluation image.

A developer is put into a developing unit of the image forming apparatus, and a replenishing toner (the same toner as the toner used in the developer) is put into a toner cartridge.

In this apparatus, the total load applied to the contact area in which the fixing belt and pressure roller of the fixing device are in contact with each other is 28 N, and the length of the contact area along the transport direction of a recording medium is 9.0 mm.

The fixing belt is an endless belt including a polyimide resin substrate having a thickness of 30 μm, an elastic layer containing a silicone rubber and having a thickness of 200 μm, and a release layer containing a fluorine resin and having a thickness of 30 μm, each layer being disposed in sequence. The total thickness of the fixing belt is 260 μm.

The fixing temperature is 160° C., and a processing speed is 100 mm/s.

This modified machine is used to form solid images on the entire surfaces on both sides of 100 sheets of plain paper (J paper manufactured by Fuji Xerox Co., Ltd., thickness: 0.097 mm), thin-layer coated paper (glossy coated paper manufactured by Oji Paper Co., Ltd., thickness: 0.10 mm), and embossed paper (LEATHAC 66 manufactured by Fuji Xerox Co., Ltd., thickness: 0.16 mm) for each; and these 100 sheets of each type of paper with the formed images are continuously output.

On the 100th output sheet of each type of paper, both the front end and rear end of the image subjected to a first fixing process in double-sided printing are observed and evaluated on the basis of the following criteria.

A: Observed image has no blank, roughness, and uneven image density

B: Observed image has very slight roughness, but practically no problem

C: Observed image has at least one of blank, roughness, and uneven image density to a small extent D: Observed image has at least one of blank, roughness, and uneven image density

TABLE 1

| | Developer | Condition 1: | Condition 2: | Glass transition temperature of amorphous resin | Melting temperature of release agent | | Release agent domain: Number frequency distribution of aspect ratio | | Release agent domain: Maximum length | image defects and evaluation: Plain paper | image defects and evaluation: Thin-layer coated paper | image defects and evaluation: Embossed paper |
|---|---|---|---|---|---|---|---|---|---|---|---|---|
| | No. | $T_2/T_1$ | $T_1$ | $T_3$ [° C.] | $T_4$ [° C.] | $T_4$-$T_3$ | Mode | Skewness | [nm] | | | |
| Example 1 | (1) | 1.310 | 58 | 59 | 81 | 22 | 1.30 | 1.17 | 880 | A | A | A |
| Example 2 | (2) | 1.241 | 63 | 59 | 81 | 22 | 1.43 | 1.24 | 920 | A | B | A |
| Example 3 | (3) | 1.345 | 53 | 59 | 81 | 22 | 1.16 | 1.10 | 850 | A | A | B |
| Example 4 | (4) | 1.330 | 61 | 52 | 81 | 29 | 1.33 | 1.20 | 860 | B | A | B |
| Example 5 | (5) | 1.225 | 66 | 52 | 81 | 29 | 1.41 | 1.23 | 870 | B | B | B |
| Example 6 | (6) | 1.304 | 57 | 59 | 81 | 22 | 1.25 | 1.12 | 780 | A | A | A |
| Example 7 | (7) | 1.332 | 60 | 59 | 81 | 22 | 1.31 | 1.15 | 830 | A | A | B |
| Example 8 | (8) | 1.295 | 56 | 59 | 81 | 22 | 1.28 | 1.18 | 750 | A | A | B |
| Example 9 | (9) | 1.355 | 52 | 59 | 81 | 22 | 1.01 | 0.85 | 450 | A | B | C |
| Comparative Example 1 | (C1) | 1.125 | 49 | 55 | 81 | 26 | 1.51 | 1.05 | 900 | B | D | C |
| Comparative Example 2 | (C2) | 1.375 | 71 | 66 | 81 | 15 | 1.02 | 0.88 | 360 | C | C | D |

From those results, the occurrence of image defects due to the re-melting of a fixed image is reduced regardless of the types of recording medium in the image forming apparatuses of Examples, which involve use of the specific toner and include a fixing device that directly heats a fixing belt with a heat source, than in the image forming apparatuses of Comparative Examples.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image holding member;

a charging unit that charges the surface of the image holding member;

an electrostatic charge image forming unit that forms an electrostatic charge image on the charged surface of the image holding member;

a developing unit that has an electrostatic charge image developer and that develops the electrostatic charge image on the surface of the image holding member with the electrostatic charge image developer to form a toner image;

a transfer unit that transfers the toner image formed on the surface of the image holding member to a recording medium; and a fixing unit that includes a fixing belt that comes into contact with the toner image transferred to the recording medium, a rotational member that is disposed in contact with the outer surface of the fixing belt and that forms a contact area between the fixing belt and the rotational member, and a heat source that is disposed so as to face the inner surface of the fixing belt to directly heat the fixing belt, wherein the electrostatic charge image developer contains a toner that has a temperature $T_1$ at a storage modulus of $G'=1\times10^8$ Pa and a temperature $T_2$ at a storage modulus of $G'=1\times10'$ Pa and that satisfies a condition 1 and a condition 2, and the recording medium having the transferred toner image passes through the contact area to fix the toner image to the recording medium $$1.215 \leq T_2/T_1 \leq 1.365 \quad \text{Condition 1:}$$

$$50° \text{ C.} \leq T_1 \leq 68° \text{ C.}, \quad \text{Condition 2:}$$

wherein the toner contains toner particles containing a binder resin and a release agent;

the release agent forms a domain inside the toner particles; and in number frequency distribution of the aspect ratio of the domain, a mode is from 1.10 to 1.50, and a skewness is from 1.05 to 1.30.

2. The image forming apparatus according to claim 1, wherein the total load applied to the contact area is from 22 N to 30 N, and the length of the contact area along the transport direction of the recording medium is from 8.0 mm to 10.0 mm.

3. The image forming apparatus according to claim 1, wherein the thickness of the fixing belt is from 130 μm to 1000 μm.

4. The image forming apparatus according to claim 1, wherein the toner contains toner particles containing an amorphous resin and a release agent, and a difference between the glass transition temperature of the amorphous resin and the melting temperature of the release agent is from 10° C. to 40° C.

5. The image forming apparatus according to claim 1, wherein the average of the maximum length of the domain is 100 nm or more and less than 300 nm.

6. The image forming apparatus according to claim 1, wherein the average of the maximum length of the domain is from 300 nm to 1500 nm.

7. A method for forming an image, the method comprising:

charging the surface of an image holding member;

forming an electrostatic charge image on the charged surface of the image holding member;

developing the electrostatic charge image on the surface of the image holding member with an electrostatic charge image developer to form a toner image;

transferring the toner image formed on the surface of the image holding member to a recording medium; and fixing the toner image transferred to the recording medium, unit that includes a fixing belt that comes into contact with the toner image transferred to the recording medium, a rotational member which is disposed in contact with the outer surface of the fixing belt and which forms a contact area between the fixing belt and the rotational member, and a heat source which is disposed so as to face the inner surface of the fixing belt to directly heat the fixing belt, the electrostatic charge image developer contains a toner that has a temperature $T_1$ at a storage modulus of $G'=1\times10^8$ Pa and a temperature $T_2$ at a storage modulus of $G'=1\times10^6$ Pa and that satisfies a condition 1 and a condition 2, and the recording medium having the transferred toner image passes through the contact area to fix the toner image to the recording medium Condition 1: $1.215 \leq T_2/T_1 \leq 1.365$ Condition 2: $50° \text{ C.} \leq T_1 \leq 68° \text{ C.}$, wherein the toner contains toner particles containing a binder resin and a release agent;

the release agent forms a domain inside the toner particles; and in number frequency distribution of the aspect ratio of the domain, a mode is from 1.10 to 1.50, and a skewness is from 1.05 to 1.30.

* * * * *